US006470799B2

(12) United States Patent
Nakazawa et al.

(10) Patent No.: US 6,470,799 B2
(45) Date of Patent: Oct. 29, 2002

(54) COMPUTER-TO-CYLINDER TYPE LITHOGRAPHIC PRINTING METHOD AND COMPUTER-TO-CYLINDER TYPE LITHOGRAPHIC PRINTING APPARATUS

(75) Inventors: Yusuke Nakazawa, Shizuoka (JP); Hideyuki Koguchi, Kanagawa (JP); Kazuo Ishii, Shizuoka (JP); Eiichi Kato, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/818,529

(22) Filed: Mar. 28, 2001

(65) Prior Publication Data

US 2002/0023566 A1 Feb. 28, 2002

(30) Foreign Application Priority Data

Mar. 29, 2000 (JP) ..... 2000-092082

(51) Int. Cl.[7] ..... B41C 1/10; B41J 2/06

(52) U.S. Cl. ..... 101/466; 347/12; 347/19; 347/104

(58) Field of Search ..... 101/463.1, 465, 101/466, 467, 401.1; 347/11, 12, 13, 14, 15, 19, 55, 101, 104

(56) References Cited

U.S. PATENT DOCUMENTS

| | | | | | |
|---|---|---|---|---|---|
| 4,718,340 | A | * | 1/1988 | Love, III | 101/467 |
| 5,142,296 | A | * | 8/1992 | Lopez et al. | 347/12 |
| 5,182,990 | A | * | 2/1993 | Kline et al. | 101/467 |
| 5,428,380 | A | * | 6/1995 | Ebisawa | 347/12 |
| 5,734,398 | A | * | 3/1998 | Mitani | 347/57 |
| 5,801,732 | A | * | 9/1998 | Pengelly | 347/70 |
| 5,868,075 | A | * | 2/1999 | Kline et al. | 101/467 |
| 5,923,348 | A | * | 7/1999 | Cunnagin et al. | 347/42 |
| 6,152,037 | A | * | 11/2000 | Ishii et al. | 101/466 |
| 6,172,689 | B1 | * | 1/2001 | Cunnagin et al. | 347/8 |
| 6,341,559 | B1 | * | 1/2002 | Riepenhoff et al. | 101/463.1 |

FOREIGN PATENT DOCUMENTS

| | | |
|---|---|---|
| EP | 0 988 968 A1 | 3/2000 |
| GB | 2 351 699 A | 1/2001 |
| JP | A-64-27953 | 1/1989 |
| JP | A-4-97848 | 3/1992 |
| JP | A-11-268227 | 10/1999 |

* cited by examiner

*Primary Examiner*—Stephen R. Funk
(74) *Attorney, Agent, or Firm*—Sughrue Mion, PLLC

(57) ABSTRACT

A method of computer-to-cylinder lithographic printing, comprising: loading a plate material on a rotative plate cylinder of a lithographic printing apparatus; rotating the plate cylinder having loaded thereon the plate material; forming an image directly onto the plate material by an inkjet image-recording process which comprises ejecting an oil-based ink from a recording head having a plurality of ejecting channels, based on image data signals, utilizing an electrostatic field, to prepare a printing plate; subsequently performing lithographic printing with the thus prepared printing plate, wherein the recording head is driven so that every n'th channel thereof is actuated in a common phase, and wherein the plate cylinder is rotated to give a surface rotational speed V (mm/sec) of the plate material as represented by the following formula:

$$V=25.4\times(f\times n)/N$$

wherein N represents a recording resolution (dots/25.4 mm) along a rotative direction of the plate cylinder on the plate material, and f represents a driving frequency f (Hz) of each ejecting channel of the recording head.

18 Claims, 8 Drawing Sheets

COMPUTER-TO-CYLINDER TYPE LITHOGRAPHIC PRINTING METHOD AND COMPUTER-TO-CYLINDER TYPE LITHOGRAPHIC PRINTING APPARATUS

FIELD OF THE INVENTION

The present invention relates to a digital cylinder-to-plate type lithographic printing method and a lithographic printing apparatus, and particularly to a method of plate making with oil-based ink, printing with such plates and printing apparatuses characterized by superior image quality of the plate as well as the final printed matter.

BACKGROUND OF THE INVENTION

In the conventional lithographic printing, an ink-receptive area and an ink-repelling area are formed on the surface of a printing plate, and a printing ink is fed on the plate so as for the ink to selectively adhere to the ink-receptive area. The adhering printing ink is then transferred to paper. Usually, the hydrophilic area and the oleophilic (ink-receptive) area are formed imagewise on the surface of a printing plate. Then, the hydrophilic area is moistened with dampening water to repel the printing ink.

Image recording on the printing plate material (plate making) is carried out, as the most popular method, by first outputting, via an analog or a digital method, an original image on a silver halide photographic film, through which a photosensitive diazo resin or a photopolymer-based layer is exposed to light, and removing such a photosensitive layer at the non-image areas with an alkaline developer.

Recently, with the advance of digital image formation technologies and with the demand for a higher efficiency of printing workflow, a variety of proposals are being made on a system that can directly output images on printing plate using digital image information. Such methods are often called CTP (Computer-To-Plate), or DDPP (Digital Direct Printing Plate). The plate making method suited for CTP includes those based on laser exposure in light or heat mode, and some of them are being in practical use.

However, such plate making methods based on laser exposure suffer from an environmental drawback caused by the use of alkaline developer needed to remove background areas of the plate material after image exposure. This drawback is common to the light and heat modes.

In order to make printing process efficient, systems are proposed in which plate making is carried out on printing apparatuses. Some of such systems are based on laser exposure, but they require expensive and bulky apparatuses. Hence, systems based on inkjet imaging are under investigation as they use inexpensive and compact image recording apparatuses.

Japanese Patent Laid-Open No. 97848/1992 discloses such an on-cylinder image recording system in which a plate drum having a hydrophilic or an oleophilic surface is used instead of the conventional plate cylinder, and in which an oleophilic or a hydrophilic image is formed with inkjet recording. The image is then used for printing, and removed or erased after printing. However, this method suffers from a difficulty in the consistency of the ease of image erasing with image durability. Further, in order to form sufficiently durable images on the plate cylinder, inkjet inks with relatively high contents of resinous ingredients concentrations are required. Such type of ink tends to cause the solidification of the resin at inkjet nozzles due to solvent evaporation there, leading to a poor consistency in ink ejection. Thus, it is difficult to consistently form high quality images.

Japanese Patent Laid-Open No. 27953/1989 discloses a plate making method comprising image formation by inkjet recording using an oleophilic wax ink onto a hydrophilic plate material. However, the wax image made by this method suffers from a poor print durability because waxes are mechanically weak and poorly adhere to the hydrophilic plate surface.

Japanese Patent Laid-Open No.268227/1999 discloses a computer-to-cylinder type printing method in which image recording is carried out by an inkjet recording process. The process comprises application of an intense electric field at an ink ejecting point to ink comprising a hydrophobic particulate resinous material dispersed in an insulating solvent so as for the resinous material to aggregate and eject as a highly condensed fluid. Owing to such concentration mechanism, dots formed by this method have a sufficient thickness enough to stand large run lengths. However, in this electrostatic inkjet recording, ink ejects under the application of a potential as high as several kV, and in cases where the recording head has a plurality of ejecting channels, adjacent channels tend to suffer from electric field interference that makes the flying locus of ejected ink droplets unstable, leading to inaccurate dot placement on the recording plane. Therefore, the electric field interference makes dense arrangements of the ejecting channels difficult.

SUMMARY OF THE INVENTION

The present invention has been made to solve the foregoing problems.

Accordingly, an object of the invention is to provide a lithographic printing method and apparatus not requiring any development processing in which the electric field interference among the ejecting channels of the recording head is prevented.

Another object of the invention is to provide a lithographic printing method and apparatus is capable of making, via inexpensive and simple methods, a printing plate from which a large number of high quality prints can be produced.

Other objects and effects of the invention will become apparent from the following description.

The above-described objects of the invention have been achieved by providing the following items.

(1) A method of computer-to-cylinder lithographic printing, comprising:

loading a plate material on a rotative plate cylinder of a lithographic printing apparatus;

rotating said plate cylinder having loaded thereon the plate material;

forming an image directly onto the plate material by an inkjet image-recording process which comprises ejecting an oil-based ink from a recording head having a plurality of ejecting channels, based on image data signals, utilizing an electrostatic field, to prepare a printing plate;

subsequently performing lithographic printing with the thus prepared printing plate, wherein said recording head is driven so that every n'th channel thereof is actuated in a common phase, and wherein said plate cylinder is rotated to give a surface rotational speed V (mm/sec) of the plate material as represented by the following formula:

$V=25.4\times(f\times n)/N$ wherein N represents a recording resolution (dots/25.4 mm) along a rotative direction of the plate cylinder on said plate material, and f represents a driving frequency f (Hz) of each ejecting channel of said recording head.

(2) The computer-to-cylinder lithographic printing method according to item (1) above, wherein said oil-based ink comprises;

a non-aqueous solvent having a specific resistance not lower than $10^9$ Ωcm and a dielectric constant not higher than 3.5; and a hydrophobic particulate resin dispersed in said solvent, the resin being solid at least at room temperature.

(3) A computer-to-cylinder lithographic printing apparatus comprising:

a rotative plate cylinder on which a plate material is to be loaded;

an image forming unit comprising an inkjet recording unit including a recording head having a plurality of ejecting channels so as to form an image directly on the plate material loaded on said plate cylinder by ejecting an oil-based ink from said recording head, based on image data signals, utilizing an electrostatic field to prepare a printing plate;

an image data processing and control unit which drives said recording head so that every n'th channel of said recording head is actuated in a common phase;

a plate cylinder's rotational speed-controlling unit which control the rotational speed of said plate cylinder to give a surface rotational speed V (mm/sec) of the plate material as represented by the following formula:

$V=25.4\times(f\times n)/N$ wherein N represents a recording resolution (dots/25.4 mm) along a rotative direction of the plate cylinder on said plate material, and f represents a driving frequency f (Hz) of each ejecting channel of said recording head; and a lithographic printing unit which performs lithographic printing with the thus prepared printing plate.

(4) The computer-to-cylinder lithographic printing apparatus according to item (3) above, wherein said oil-based ink comprises:

a non-aqueous solvent having a specific resistance not lower than $10^9$ Ωcm and a dielectric constant not higher than 3.5; and a hydrophobic particulate resin dispersed in said solvent, the resin being solid at least at room temperature.

(5) The computer-to-cylinder lithographic printing apparatus according to item (3) or (4) above, wherein said image forming unit further comprises an ink fixing unit.

(6) The computer-to-cylinder lithographic printing apparatus according to any one of items (3) to (5), wherein said image forming unit further comprises a dust cleaning unit which removes dust present on the plate at least one of prior to and during image recording onto said plate material.

(7) The computer-to-cylinder lithographic printing apparatus according to any one of items (3) to (6) above, wherein said image forming unit rotates said plate cylinders to perform main scanning upon image recording onto the plate material.

(8) The computer-to-cylinder lithographic printing apparatus according to item (7) above, wherein said recording head comprises multiple channels and is movable along a direction parallel to an axis of said plate cylinder to perform sub-scanning upon image recording onto the plate material.

(9) The computer-to-cylinder lithographic printing apparatus according to item (7) above, wherein said recoding head comprises a full-line head having a width substantially equal to that of said plate material.

(10) The computer-to-cylinder lithographic printing apparatus according to any one of items (3) to (9) above, wherein said inkjet recording unit further comprises an ink feeding member which feeds the ink to said ink ejecting head.

(11) The computer-to-cylinder lithographic printing apparatus according to item (10) above, wherein said inkjet recording unit further comprises an ink recovery member which recovers said oil-based ink from said recording head to circulate said ink in cooperation with said ink feeding member.

(12) The computer-to-cylinder lithographic printing apparatus according to any one of items (3) to (11) above, wherein said inkjet recording unit further comprises an ink tank and an ink agitating member installed inside said ink tank.

(13) The computer-to-cylinder lithographic printing apparatus according to item (12) above, wherein said inkjet recording unit further comprises an ink temperature control member installed inside said ink tank.

(14) The computer-to-cylinder lithographic printing apparatus according to any one of items (3) to (13) above, wherein said inkjet recording unit further comprises an ink concentration control member.

(15) The computer-to-cylinder lithographic printing apparatus according to any one of items (3) to (14) above, wherein said inkjet recording unit further comprises a recording head distancing/approximating member capable of approximating said recording head to said plate cylinder upon image recording onto the plate material and of distancing said recording head from said plate cylinder except during the image recording.

(16) The computer-to-cylinder lithographic printing apparatus according to any one of items (3) to (15) above, wherein said image forming unit further comprises a cleaning member which cleans said ink ejecting head at least after the completion of the plate making.

(17) The computer-to-cylinder lithographic printing apparatus according to any one of items (3) to (16) above, wherein said lithographic printing unit comprises a dust removing member which removes paper dust generating during lithographic printing.

(18) The computer-to-cylinder lithographic printing apparatus according to any one of items (3) to (17) above, wherein said image forming unit has a recording head temperature control member.

DETAILED DESCRIPTION OF THE INVENTION

In the following, some practical embodiments for carrying out the invention will be described in detail.

The invention is characterized by the prevention of the electric field interference among the ejecting channels of an inkjet recording head used for image formation on a plate material loaded on the plate cylinder of a printing apparatus with an oil-based ink ejected by means of electrostatic field.

The inkjet recording method associated with the invention is such as described in PCT Publication WO93/11866, and comprises application of an intense electric field at an ink ejecting point to highly electrically insulating ink comprising a hydrophobic particulate resinous material dispersed in an insulating solvent thus causing the resinous material to aggregate and eject as a highly concentrated aggregate. Owing to such concentration mechanism, dots formed by this method on plate materials comprise aggregated resin particles having a sufficient thickness enough to stand large run lengths.

In the present inkjet method, the dimension of the end of an ejecting electrode or the conditions of electrostatic field formation determines the size of ink droplet. Thus, by using a small ejecting electrode or by optimizing the electrostatic field forming conditions, one can realize minute ink droplets without reducing the ink ejecting nozzle diameter or slit width.

Accordingly, a fine-tuning in recording high-resolution durable images is possible without accompanying the drawback of nozzle choking with ink. Based on such an inkjet recording method, the invention provides a plate making method and apparatus that can make printing plates from which crisp and sharp prints can be made in a large number.

One configurational example of the computer-to-cylinder type lithographic printing apparatus to practice the lithographic printing method of the invention will be described in the following.

Figure 1:
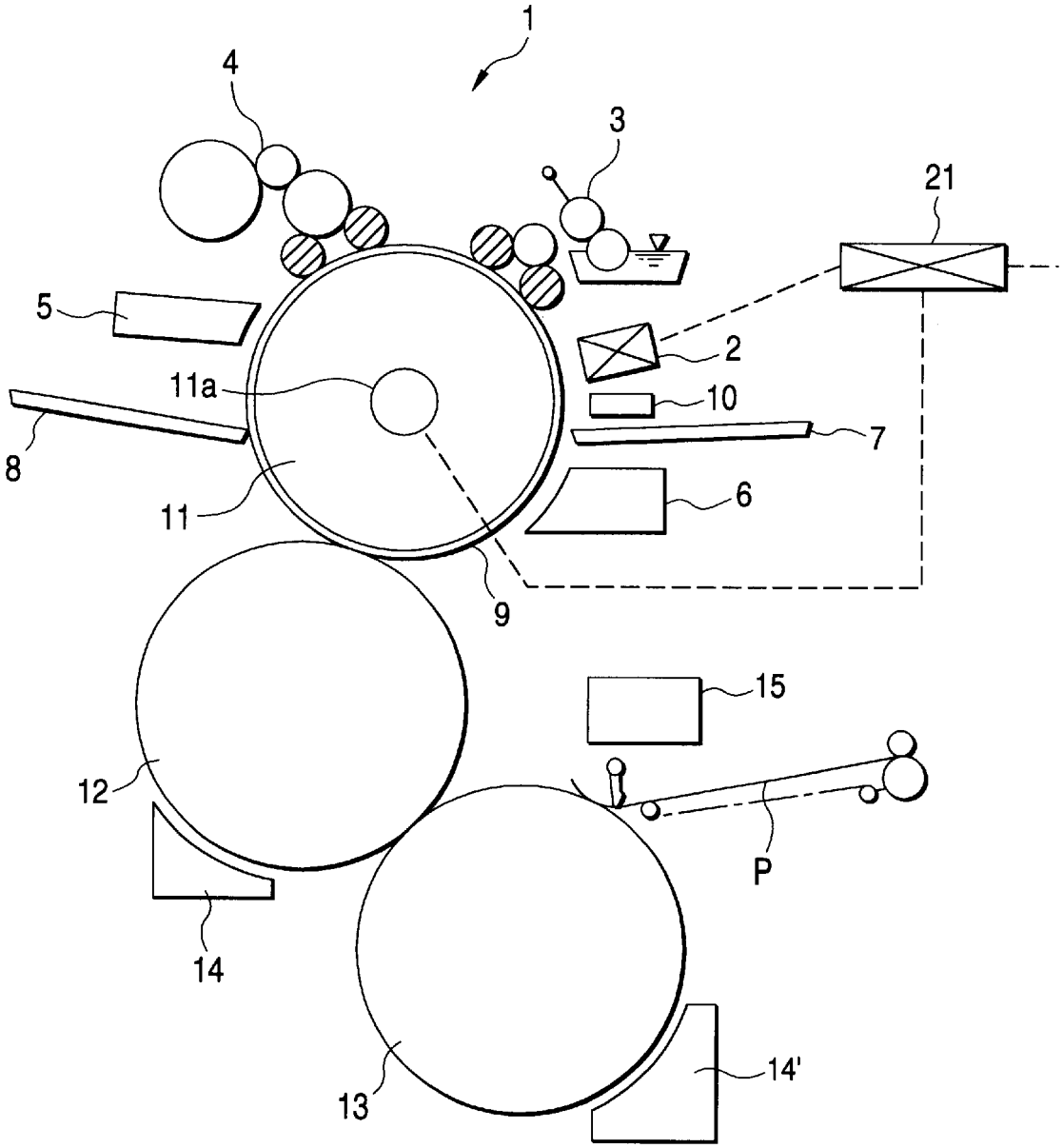
FIG. 1 illustrates the entire construction of an example of the computer-to-cylinder type single-color, one side lithographic printing apparatus for use in the invention.
Figure 2:
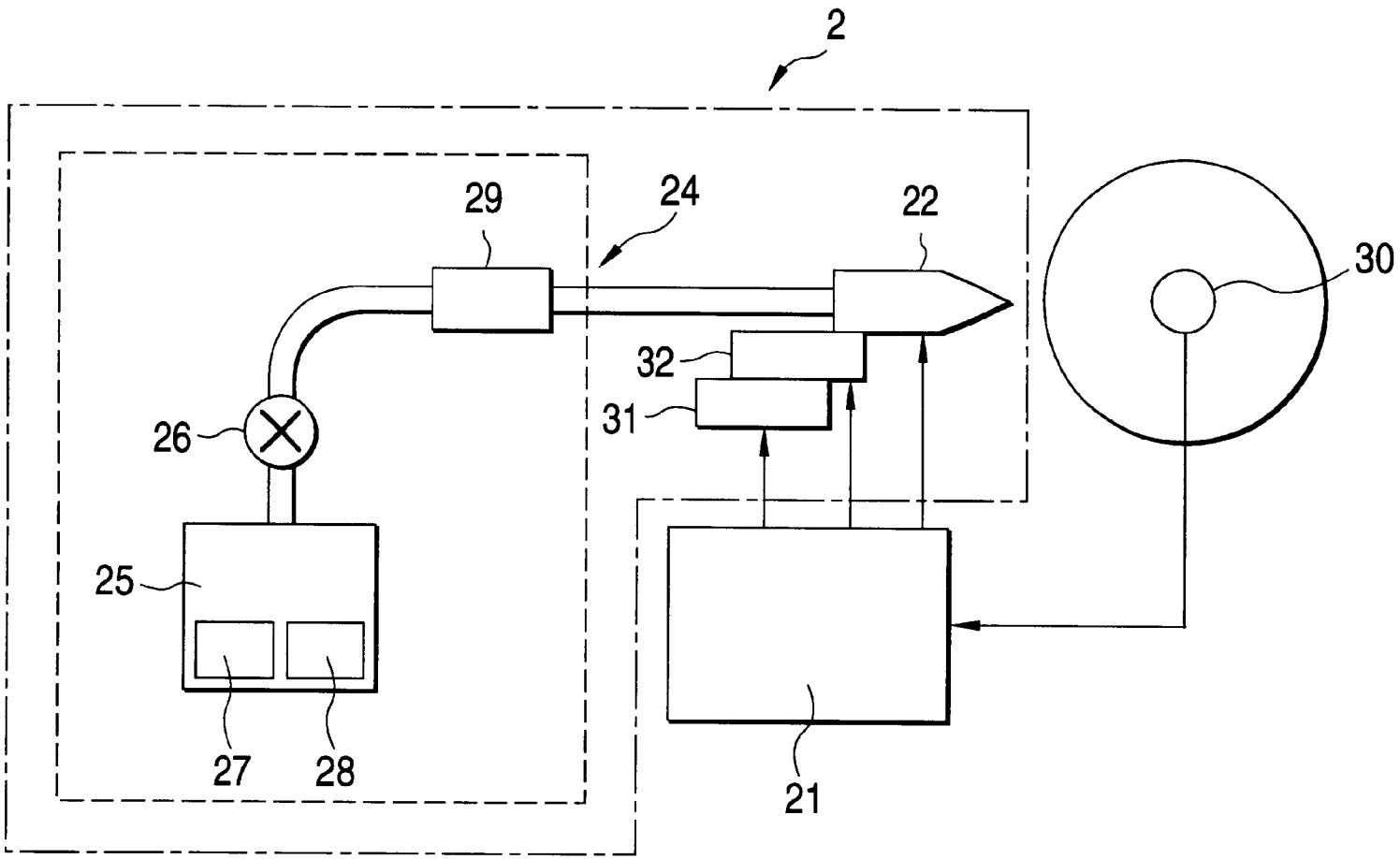
FIG. 2 illustrates the construction of an example of the image recording unit of the computer-to-cylinder type single-color, one side lithographic printing apparatus for use in the invention.
Figure 3A:
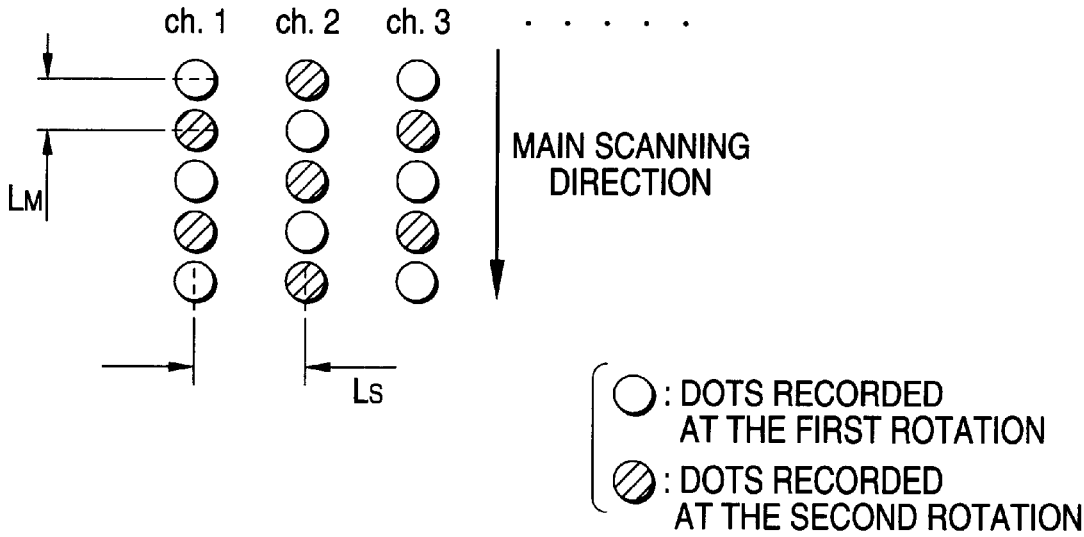
FIGS. 3(*a*) and 3(*b*) are drawings to explain the method of controlling the actuation of ejecting channels and the rotational speed of the plate cylinder in accordance with the invention.
Figure 3B:
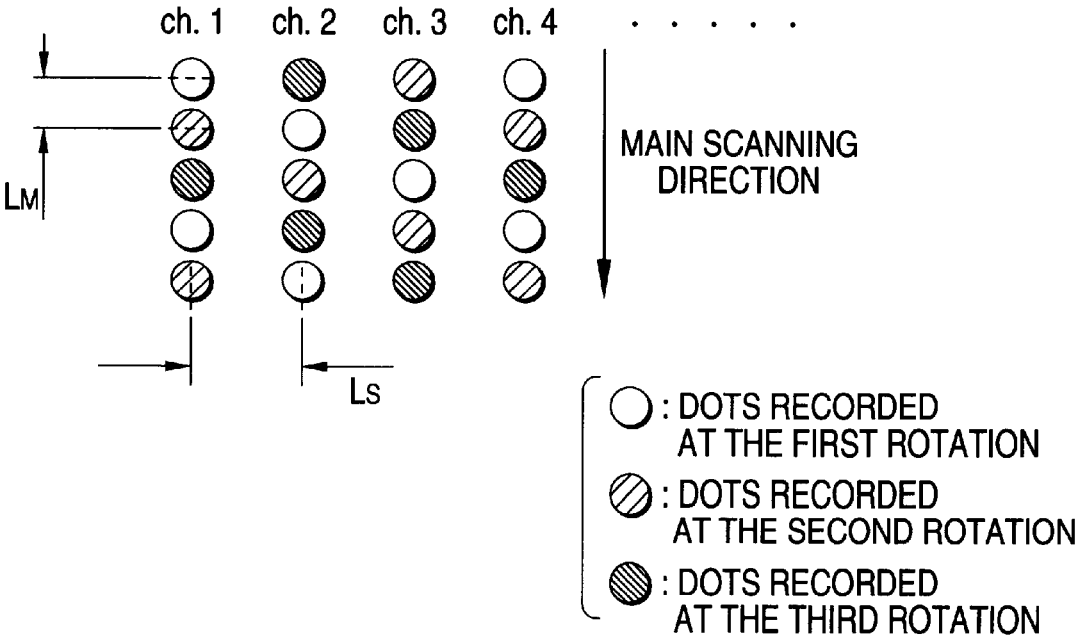

FIG. 1 shows the entire configuration of a single color, single-side computer-to-cylinder type lithographic printing apparatus. FIG. 2 schematically illustrates the image recording unit of the apparatus in FIG. 1 comprising a control unit, a ink feeding unit and a head distancing/approximating mechanism. FIG.3 is a drawing to explain how to control the rotational speed of the plate cylinder. With FIGS. 4 to 10, the inkjet recording unit installed in the apparatuses shown in FIG. 1 and FIG. 11 are described. And, FIG. 11 illustrates the entire configuration of a four color, single-side computer-to-cylinder type lithographic printing apparatus associated with the invention.

With reference to FIG. 1 that shows the entire construction of a single color, single-side computer-to-cylinder type lithographic printing apparatus, the printing procedure of the invention will be explained. As is shown in FIG. 1, the computer-to-cylinder type lithographic printing apparatus (hereinafter, also referred to as printing apparatus) comprises one plate cylinder 11, one blanket cylinder 12 and one impression cylinder 13. At least while lithographic printing is carried out, blanket cylinder 12 that transfers images is in a pressed contact with plate cylinder 11, and impression cylinder 13 is pressed to blanket cylinder 12 so that the image once transferred onto blanket cylinder 12 be again transferred to printing paper P.

Plate cylinder 11 is usually made of metal, and its surface may be plated with chromium for a better durability, or covered with an adiabatic material to be described later. In the case where an electrostatic inkjet system is used, plate cylinder 11 is desirably grounded as it acts as the counter electrode to the ejecting head. Further, when the base material of the plate is highly electrically insulating, an electrically conductive layer may be provided on the base with which the plate cylinder is connected to have the common ground potential. For that purpose, any of well-known means including a brush, a board spring and a roller made of conductive material may be used.

On the other hand, plate cylinder 11 has a rotational speed-controlling unit 11*a,* which regulates the rotational speed of the plate cylinder at a pre-determined value at least during image recording.

Further, printing apparatus 1 has inkjet recording (imaging) unit 2, which ejects an oil-based ink onto plate material 9 loaded on plate cylinder 11 in response to the image data sent from image data processing and control unit 21.

Printing apparatus 1 also has unit 3 that supplies dampening water to the hydrophilic (non-image) areas of plate 9. FIG. 1 depicts a Molleton type unit as a typical dampening water supplying means, but other types for the same purpose known in the art can be used such as Shinflo type or continuous flow type ones.

Printing apparatus 1 has also a printing ink feeder 4 and a fixing unit that acts to strengthen the durability of the inkjet image formed on plate material 9. If needed, desensitization unit 6 may also be equipped that improves the hydrophilic nature of the plate surface.

Printing apparatus 1 has furthermore dust-cleaning member 10 that eliminates dust present on the plate material surface prior to or during recording. Dust removal can be achieved by any method known in the art including non-contact ones such as blow-off or electrostatic removing, and contact ones using a brush or a roller. Among them, the most preferable method is air suction or blowing. Such methods can be applied separately or in combination. In any case, the pump equipped in the printing apparatus for printing paper feed may be diverted for the dust removal.

Printing apparatus 1 may further have automatic plate material loader 7 that automatically loads plate material 9 onto plate cylinder 11, automatic plate unloader 8 that removes plate 9 from plate cylinder 11 after printing operation has finished. Commercially available printing apparatuses equipped with these ancillary units well known in the art include, for example, Hamada VS34A and B452A, products of Hamada Printing apparatusry Co., Ltd., Toko 8000PFA of Tokyo Koku Keiki Co., Ltd., Ryobi 3200ACD and 3200PFA, products of Ryobi Imagix Co., Ltd., AMSIS Multi 5150FA of AM Japan Co., Ltd, Oliver 266EPZ of Sakurai Graphic Systems Co., Ltd., and Shinohara 661IV/IVP sold by Shinohara Trading Co., Ltd. Still other optional units include blanket washing unit 14 and impression cylinder washing unit 14'. The advantageous features of the invention can be enhanced with the use of those accessories 7, 8, 14 and 14', because printing operations become easy and the turnaround time is shortened. It is also desirable to arrange paper dust-preventing unit 15 close to plate cylinder 13 to prevent paper dust from depositing on the plate material. Paper dust prevention can be performed by humidity control, dust suction with air or electrostatic dust collection.

Image data processing and control unit 21 receives image data from image scanners, magnetic disk devices or image data transmission devices, and, when needed, separates color information, and divides each color-separated data into suitable pixels and gradation levels. Further, in order to output oleophilic, halftone inkjet images by using ink ejecting head 22 (See FIG. 2. A detailed description will be given later.) belonging to inkjet recording unit 2, area coverage values are calculated, too.

As will be described in detail soon, image data processing and control unit 21 also controls the movement of inkjet head 22, the ejection timing of oil-based ink, and, when required, the operation timing of plate, blanket and impression cylinders 11, 12 and 13.

With reference to FIG. 1 and partly to FIG. 2, a detailed description on the plate making procedures with printing apparatus 1 will follow.

First, plate material 9 is attached to plate cylinder 11 with use of automatic plate loader 7. Such an attaching operation can be carried out by a mechanical means of grasping the leading or trailing edge of the plate material, an air suction device or by an electrostatic method, all well known in the art. As the entire area of the plate material is fixed on the plate cylinder in an intimate contact with it, the trailing edge of the plate material will never flap, thus not damaging inkjet recording unit 2 placed close to the plate cylinder during recording. Alternatively, a similarly desirable condition can be realized by keeping the plate material in an intimate contact with the plate cylinder only at a limited area including the recording position for the inkjet recording unit. Practically, for example, plate-suppressing rollers may be arranged at the upstream and downstream sides of the recording position. Also, one can install, during the operation of plate loading, means of preventing the trailing edge of the plate from contacting with the ink supplying roller so as to avert plate deterioration and reduce paper waste. Practical means include suppressing roller, guide or electrostatic attraction.

Data from, for example, magnetic discs are sent to image data processing and control unit 21, which calculates positions for ink ejection and area coverages at those positions.

The calculated data are once stored in a buffer memory. Image data processing and control unit 21 rotates plate cylinder 11 at a pre-determined speed via rotational speed control unit 11*a*, brings inkjet head 22 using head distancing/approximating unit 31 to a position close to plate cylinder 11. The gap between head 22 and the surface of plate material 9 attached on plate cylinder 11 is kept at a pre-determined value during recording by mechanical means such as a spacing roller, or by controlling the motion of the head by the head distancing/approximating unit driven by the signal from an optical gap detector.

As ejecting head 22, multi-channel type or full-line type ones may be used, and the main scanning for image recording is accomplished by rotating plate cylinder 11. In cases where the head is of multi-channel type or has a full line width, both having plural ejecting points, those points are arranged along The axial direction of the cylinder.

In the use of a multi-channel head, head 22 is moved along the drum axis after each drum rotation by image data processing and control unit 21, and an oil-based ink is ejected onto the surface of plate material 9 loaded on plate cylinder 14 so as to reproduce the calculated area coverage value at every calculated position of plate material 9. In this manner, a halftone image comprising the oil-based inkjet ink and reproducing the density distribution of the original results on plate material 9. Such operations continue until an ink image corresponding to a single color for the original completes. On the other hand, in the case of a full line width head, the head needs not move, but when the plate cylinder rotates in a pre-determined number of times, the formation of a single color image for the original completes on plate 9 thus giving rise to a printing plate. As the main scanning for recording is carried out by the rotation of the plate cylinder, the positional accuracy along the main scanning direction is raised with a very high recording speed.

Then, for the protection from damaging, ejecting head 22 is retreated from its recording position close to plate cylinder 11. Not only head 22 but also sub-scanning means 32 for the head can be separated away from the plate cylinder. Further, all of head 22, ink supplying unit 24 and sub-scanning means 32 may be distanced or approximated simultaneously. For the machine to cope with conventional printing methods, not only those units but fixing unit 5 as well as dust removing member 10 can be provided with distancing/approximating mechanisms.

The head distancing/approximating member acts to separate the recording head at least by 500 $\mu$m from the plate cylinder when the head is not operating. Such a separation may be performed with a sliding mechanism, or with an arm fixed to a certain axis and by rotating the arm around the axis to cause a pendulum-like movement of those units. With such a head retreat in its suspended state, the head is protected from physical damage and contamination, thus enjoying a long operation life.

The physical strength of the oil-based ink image thus formed is improved by applying heat with fixing unit 5. Image fixing can be performed by various methods known in the art such as heat or solvent fixing. For heat fixing, irradiation with an infrared lamp, a halogen lamp or a xenon flash lamp, heated air fixing or heat roll fixing can be adopted. In heat fixing, the degree of fixing is improved by pre-heating the plate cylinder or the plate material, recording images under the application of hot air, covering the plate cylinder with an adiabatic material, or by separating the plate from the cylinder only during fixing. Such measures may be adopted individually or in combination. Flash fixing with a xenon lamp, well known as a fixing method for electrophotographic toner, has an advantage of a very short fixing time. In solvent fixing, a solvent such as methanol and ethyl acetate that can dissolve the resinous ingredient in the ink is brought into contact with the plate in the form of spray mist or vapor, and the excessive solvent vapor is collected.

It is desirable to keep the plate material 9 away from any other mechanism including dampening unit 3, printing ink feeder 4 and blanket cylinder 12 at least in the period between the image formation with the oil-based ink with the use of ejecting head 22 and image fixing with fixing unit 5.

Lithographic printing operations after plate making is the same as the conventional ones; i.e., plate 9 holding the oil-based inkjet image is given a printing ink and dampening water, and the printing ink image is first transferred onto blanket cylinder 12 rotating with plate cylinder 11, and then further from the blanket cylinder to a sheet of printing paper passing between blanket cylinder 12 and impression cylinder 13 With the end of printing, the blanket held on blanket cylinder 12 is washed with blanket washing unit 14 to be made ready for next printing.

Next, inkjet recording unit 2 will be described in detail.

As is illustrated in FIG. 2, the image recording part of the lithographic printing apparatus of the invention comprises inkjet recording unit 2 and ink feeding unit 24. Ink feeding unit 24 comprises ink tank 25, ink feeder 26 and ink concentration controller 29. Inside ink tank 25 is equipped agitating member 27 and ink temperature management means (ink temperature control member) 28. The ink may be circulated in ejecting head 22 in which case ink-feeding unit 24 has the functions of ink recovery and circulation, too. Agitating member 27 acts to prevent the precipitation or aggregation of the solid ingredients in the ink. Practical examples of such agitating member include a rotary blade, an ultrasonic oscillator and a circulation pump, which can be used individually or in combination. Ink temperature control member 28 is needed to secure the consistency of the recorded image quality by keeping the physical properties of the ink substantially constant and thus by suppressing dot size fluctuation. Temperature control can be carried out by any known method in the art, for example, by providing ink tank 25 with a heat-generating or heat-absorbing element such as a heater or a Peltier element together with agitating member 27 that averages the temperature distribution inside the tank and a temperature sensor such as a thermostat.

The temperature of the ink stored in the tank should preferably be kept between 15° C. and 60° C., and more preferably between 20° C. and 50° C. The agitating member for temperature distribution averaging may also be used to prevent the precipitation or aggregation of the solid ingredients of the ink. In order to output high quality images consistently, the printing apparatus of the invention is provided with ink concentration controller 29. The concentration of ink is monitored optically, by measuring its physical properties such as electro-conductivity or viscosity, or by the integral number of recorded plates. In the case where physical property measurements are made, an optical detector, a conductivity or viscosity sensor is installed in the ink stock tank and/or along the ink flow path individually or in combination, and the output signals from such sensors are used for the replenishment of an ink concentrate or diluent from a corresponding reservoir (both not shown in the figure) to the ink tank. In the management based on plate number, a similar replenishment is made according to the integrated number of recorded plates and/or the frequency of recording.

In addition to the calculation of input image data, the control of the movement of the head by means of head distancing/approximating unit 31 or head sub-scanning means 32 and the control of plate cylinder rotation via plate cylinder rotation controller 11*a,* image data processing and control unit 21 actuates the head by receiving the timing pulses from encoder 30 to raise the positional accuracy along the sub-scanning direction. The positional accuracy along the sub-scanning direction in the image recording with the inkjet recording unit can also be raised by driving the plate cylinder with a highly precise driving means different from the one used for printing operation. In such cases, only the plate cylinder should preferably be driven independently of the blanket and impression cylinders which are mechanically separated from the plate cylinder. Practically, such a highly precise driving can be achieved by driving the isolated plate cylinder by decelerating the output of a high precision motor with high precision gears or a steel belt. For a high quality image recording, one or more of those measures should be used.

Now, the methods of controlling the ejection timing of the ejecting channels and the rotational speed of the plate cylinder associated with the invention will be explained referring to FIG. 3. It must be emphasized that the invention is not limited to the following descriptions. In FIG. 3, each circle represents the position of a dot to be recorded on the plate. Assuming that a 300 (dots/25.4 mm) multi-channel head is used at 600 (dots/25.4 mm) recording resolution along the drum rotation direction. Hence, the dot spacing along the main scanning direction $L_M$ is about 42.3 $\mu$m and the dot spacing along the sub-scanning direction $L_S$ is about 84.7 $\mu$m. FIG. 3(*a*), which shows only the dots recorded with channels No. 1 to No. 3, depicts a case where every other ejecting channel is synchronously actuated (n=2). As is clear from the figure, by such a head control as alternatively activating odd channels and even ones during the first rotation of the plate cylinder, the distance between the closest operating channels at least doubles as compared to the case where all the channels are operated in the same phase, thus reducing the influence of electric field interference among the ejecting electrodes (which will be described soon). Then, during the second rotation of the plate cylinder, the dot positions that have not been recorded during the first rotation, are subjected to recording to complete image formation.

In the above case, image recording completes with two rotations of the plate cylinder. However, the time required for the completion of one image can be made the sate as that for the case where all the channels are actuated at the same phase by doubling the rotational speed of the plate cylinder by means of plate cylinder rotation controller 11*a*. Further, as the highest actuating frequency of each ejecting channel is fixed at 5 kHz, insufficient ink feed to the ejecting point that might cause the density of recorded dots to undesirably decrease does not take place.

FIG. 3(*b*) illustrates the case where every third ejecting channel is actuated synchronously (n=3), showing only the dots recorded with channels Nos. 1 to 4. One image completes in three rotations of the plate cylinder, but by tripling the rotational speed of the plate cylinder, the image completion time is made unchanged from the case where all the channels are actuated at the same phase. As in the foregoing case, the highest actuating frequency of each ejecting channel is fixed at 5 kHz; thus, undesirable decrease of the density of recorded dots does not take place.

Here, the value of n should preferably be 2 to 5, and more preferably 2 to 4. For n's larger than 5 the rotational speed of the plate cylinder becomes so large that the dot shape tends to deteriorate and that the dot position accuracy along the main scanning direction falls.

The method of controlling the ejection timing and plate cylinder rotation speed composing the invention is also effective for the cases where heads of lower ejection channel densities are interlaced along the sub-scanning direction.

One example of the ink ejecting head will be described with reference to FIGS. 4 to 10, not to limit the scope of the invention to the following embodiments.

Figure 4:
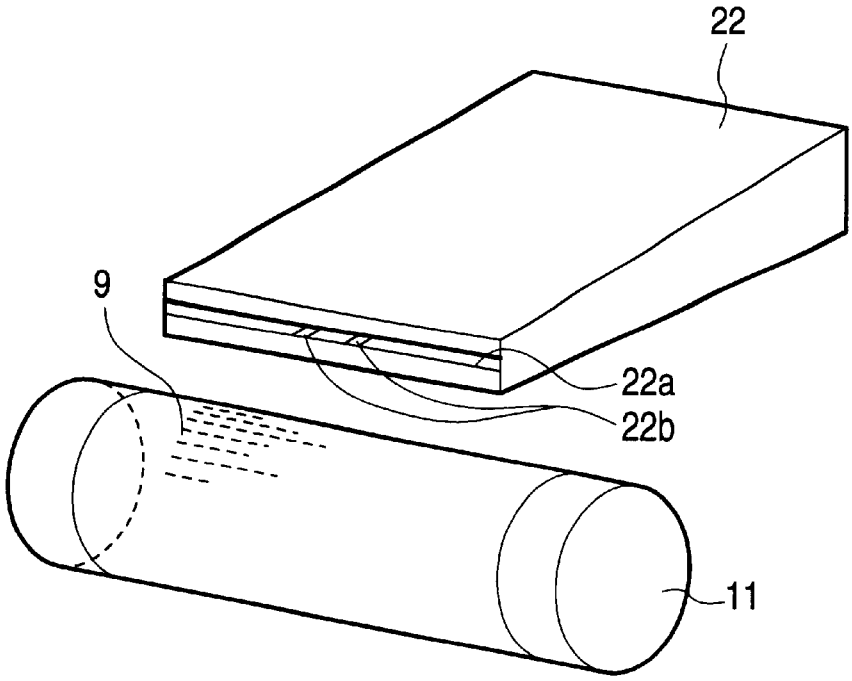
FIG. 4 schematically illustrates the construction of an example of the ejecting head to be equipped in the inkjet recording unit for use in the invention.
Figure 5:
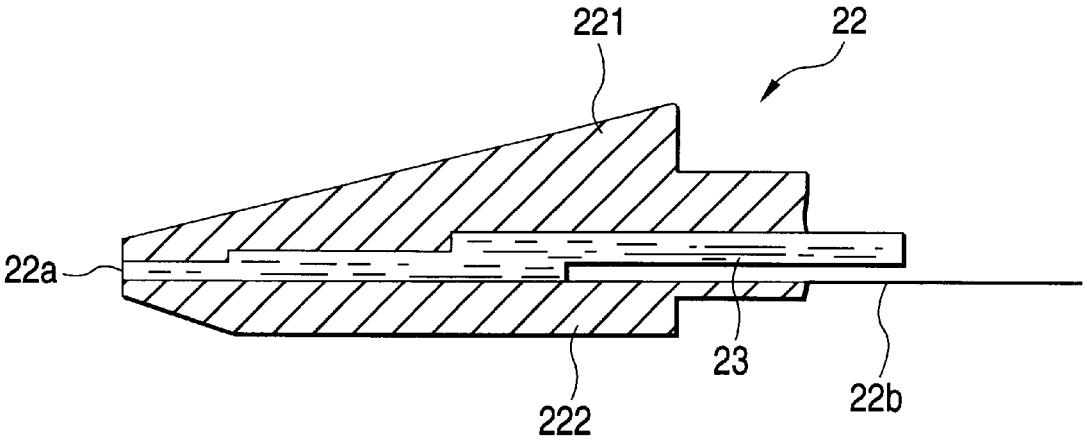
FIG. 5 schematically illustrates a cross-sectional view around the ejecting point of the head shown in FIG. 4.

FIGS. 4 and 5 depict an example of ink-ejecting head 22 equipped in the present inkjet recording unit. Head 22 has an ink-ejecting slit formed with upper unit 221 and lower unit 222, both made of an insulator and the tip of the slit 22*a* ejects ink. Inside the slit is placed ejecting electrode 22*b,* and the interior space of the slit is filled with ink 23 fed by the ink feeder. The insulator used for the upper and lower units includes plastic, glass or ceramic. Ejecting electrode 22*b* can be fabricated via various methods well known in the art; typically, on lower unit 222 comprising an insulator is formed a conductive layer comprising aluminum, nickel, chromium, gold or platinum by vacuum deposition, sputtering or electroless plating, then on the layer a photo-resist coating is formed, which is exposed through a mask having a pre-determined electrode pattern followed by development to give a photo-resist pattern of ejecting electrode 22*b,* and finally etching or mechanical removal is performed. Each of the known methods may be adopted solely or in combination with each other.

To ejecting electrode 22*b* of inkjet head 22 is applied a potential modulated by the digital signal representing an image pattern. As is shown in FIG. 4, plate cylinder 11 is arranged so as to face and act as the counter electrode to 22*b,* and there is loaded plate material 9 on plate cylinder 11 as the counter electrode. By applying a potential, a closed circuit is formed with electrode 22*b* and plate cylinder 11 acting as the counter electrode. Oil-based ink 23 is ejected from ejecting slit 22*a* of head 22, thus giving rise to an image on plate material 9 loaded on plate cylinder 11 as the counter electrode.

The tip width of ejecting electrode 22*b* should be as small as possible for high quality image formation. A preferable range, which depends on applied voltage and/or ink properties, is usually from 5 to 100 $\mu$m.

A practical example for the combination of the parameters involved is as follows; with the tip width of ejecting electrode 22*b* of 20 $\mu$m, the distance between electrode 22*b* and plate cylinder 11 as counter electrode being 1.0 mm, and by applying 3 kV between the two electrodes for 1 msec, a 40 $\mu$m diameter dot can be formed on plate material 9.

Figure 6:
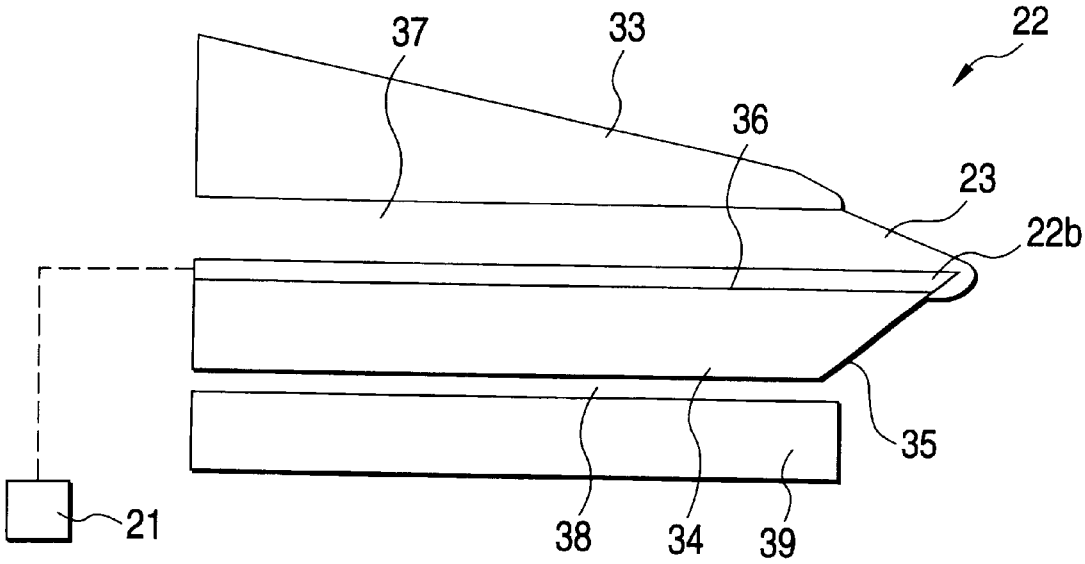
FIG. 6 schematically illustrates a cross-sectional view around the ejecting point of another example of the head to be installed in the inkjet recording unit for use in the invention.
Figure 7:
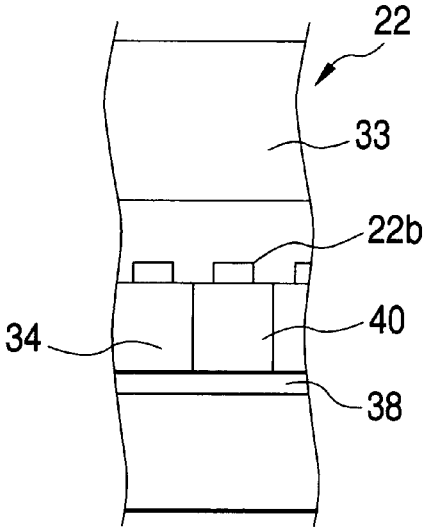
FIG. 7 is a front-end view schematically showing the neighborhood of the ejecting point of the head shown in FIG. 6.

Each of FIGS. 6 and 7 schematically depicts the cross-sectional or the front view of another ejecting head, respectively. Ejecting head 22 has a first insulating wall 33 with a tapered cross-section. A second insulating wall 34 faces this first wall 33 with an intervening space, and a t the forefront end of 34 there is formed an inclined plane 35. Those insulating walls are made of, for example, plastic, glass or ceramic.

On the upper plane 36 that forms an acute angle with the inclined forefront plane 35, plural ejecting electrodes 22*b* are provided as electrostatic field forming means at the ejecting points. The forefront end of each electrode 22*b* extends to the end of the upper plane 36, and protrudes beyond the end of the first insulating wall 33, thus forming an ink ejecting point. The space between first and second insulating walls 33 and 34 makes ink inflow path 37 through which ink 23 is fed to the ejecting point. Beneath the second insulating wall 34 is formed an ink recovery path 38. The ejecting electrodes 22*b* are formed on second insulating wall 34 by any conventional method well known in the art using a conductive material such as aluminum, nickel, chromium gold or platinum. Each electrode 22*b* is electrically insulated from each other.

The length by which the end of ejecting electrode 22*b* protrudes beyond the end of wall 33 should not exceed 2 mm. When this length is larger than the cited limit, the ink meniscus will not reach the end of the ejecting electrode, in which case ink ejection becomes difficult or the recording frequency drops. The space between walls 33 and 34 should be 0.1 to 3 mm. Narrower spaces than this range make ink feed difficult, and also cause the drop of recording frequency. On the other hand, broader spaces make the ink meniscus unstable, causing ink ejection inconsistent.

Ejecting electrode 22*b* is connected to image data processing and control unit 21, and to carry out image recording, control unit applies a potential modulated by image data to the ejecting electrode, causing ink ejection onto the plate material (not shown in the figure) arranged to face the ejecting point of the electrode. The other end of ink inflow path 37 directed opposite to the direction of ink droplet ejection is connected to the feeding member of an ink feeder not shown in the figure. Facing to the other side of the second insulating wall 34 opposite to the side on which ejecting electrode is provided, backing 39 is arranged parallel to 34 with an intervening spacing. The spacing in-between forms ink-recovery path 38. This spacing should preferably be not narrower than 0.1 mm from the viewpoint of the difficulty of ink recovery as well as the prevention of ink leakage. Ink recovery path 38 is connected to an ink recovery member of an ink feeder not shown in the figure.

In the case where a uniform ink flow on the ejecting point is needed, thin grooves 40 may be provided between the ejecting point and the ink recovery path described above. FIG. 7 schematically illustrates the front view of the ink ejecting point of the ejecting head. In the figure, the inclined front end of insulating wall 34 has a plurality of thin, linear grooves 40 running from the boundary with electrode 22*b* to ink recovery path 38. These grooves 40 are arranged over the entire row of ejecting electrodes 22*b*. Such grooves attract a certain amount of ink near the aperture of electrode 22*b* from the aperture of electrodes 22*b* by the capillary force depending on the aperture diameter, and send the attracted ink to recovery path 38. Owing to their discharging action, the grooves act to form an ink layer of a constant and uniform thickness near the end of the ejecting electrode. The shape and size of grooves 40, which are designed so as to exert a sufficient capillary force, should preferably be 10 to 200 $\mu$m wide and 10 to 300 $\mu$m deep. Grooves 40 can be provided in a number needed to form a uniform ink flow over the entire width of the ejecting head.

The width of electrode 22*b* should be as small as possible for high quality image formation. A preferable range, which depends on applied voltage and/or ink properties, is usually from 5 to 100 $\mu$m.

Figure 8:
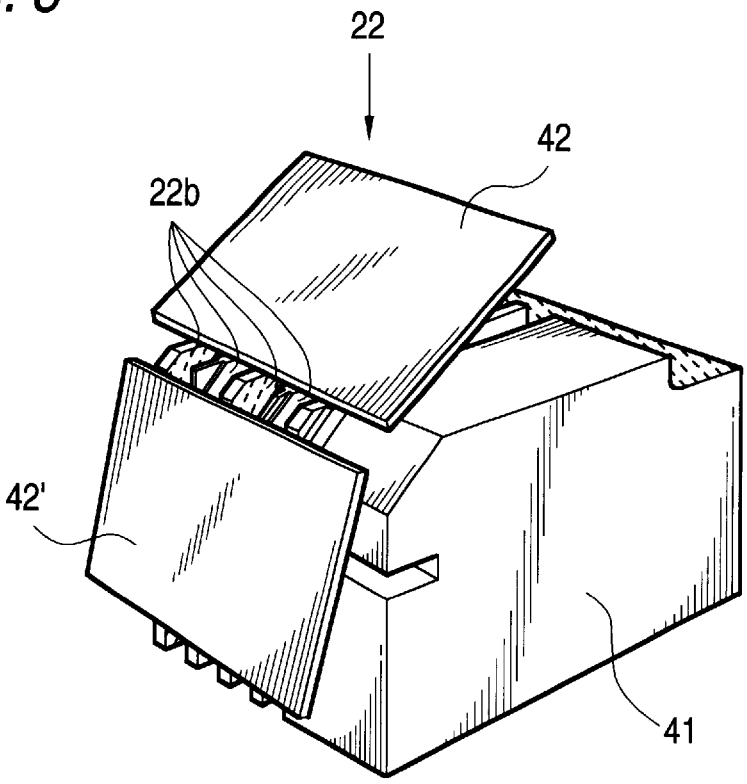
FIG. 8 schematically illustrates the main portions of another example of the ejecting head to be equipped in the inkjet recording unit for use in the invention.
Figure 9:
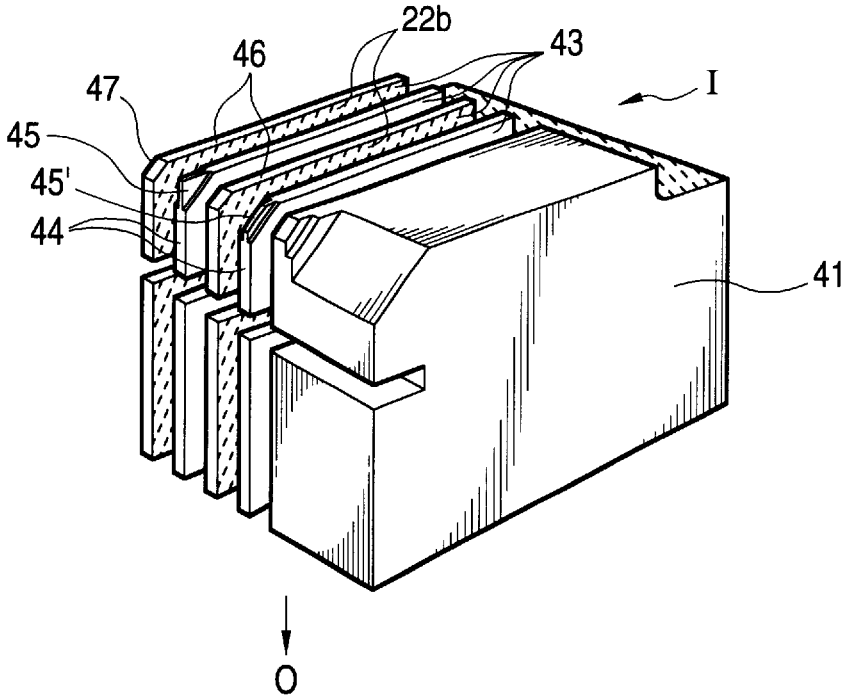
FIG. 9 schematically illustrates a bird-eye view of the ejecting head shown in FIG. 8 from which the regulating plates have been removed.

Some other examples of the ejecting head used in the invention are illustrated in FIG. 8 and FIG. 9. FIG. 8 depicts schematically a part of such a head. Head 22 comprises head body 41 made of an insulating material such as plastic, ceramic or glass and meniscus regulating plates 42 and 42'. A voltage is applied to ejecting electrode 22*b* to form an electrostatic field at the ejecting point. A more detailed description of the head body will be made with reference to FIG. 9 in which meniscus regulating plates 42 and 42' are removed.

Perpendicularly to the edge of head body 41, plural ink grooves 43 are provided for ink circulation. The shape and size of grooves 43, which are designed so as for the ink to exhibit a capillary force to achieve a uniform ink flow, should preferably be 10 to 200 μm wide and 10 to 300 μm deep. Inside grooves 43 are provided ejecting electrodes 22*b*. These electrodes can be formed on head body 40 made of an insulating material with the use of an electro-conductive material such as aluminum, nickel, chromium, gold or platinum to cover the surface of grooves 43 entirely or partly. The concrete methods of electrode formation have been already given in the description of the previous embodiment. Each ejecting electrode is isolated from each other. Contiguous two grooves form a single cell. At the tip of dividing wall 44 located at the center of the cell are provided ejecting points 45 and 45'. At these ejecting points 45 and 45', the dividing wall is fabricated thinner than the remaining area of wall 44, thus forming sharp edges.

Such a structure of the head body can be made by any method known in the art including mechanical processing, etching or molding a block of the insulating material. The thickness of the dividing wall should preferably be 5 to 100 μm, and the diameter of curvature at the sharpened edge should preferably be in the range of 5 to 50 μm. The corner of the point may be slightly beveled as ejecting point 45' shown in the figure. The figure depicts only two cells, in which the cells are separated with dividing wall 46, and its tip 47 is beveled in such a manner that tip 47 stands back relative to ejecting points 45 and 45'. An ink feeding member of an ink feeder not shown in the figure supplies ink to the ejecting points via the ink grooves from the direction designated by I. Further, excessive ink is recovered by an ink recovery member not shown in the figure to the direction designated by O. As a result, the ejecting point is always fed with fresh ink. By using such a configuration under such operating conditions described above, ink is ejected from the ejecting head to a plate material held on a drum (not shown in the figure) by the application of signal voltage modulated by image data to the ejecting electrode.

Figure 10:
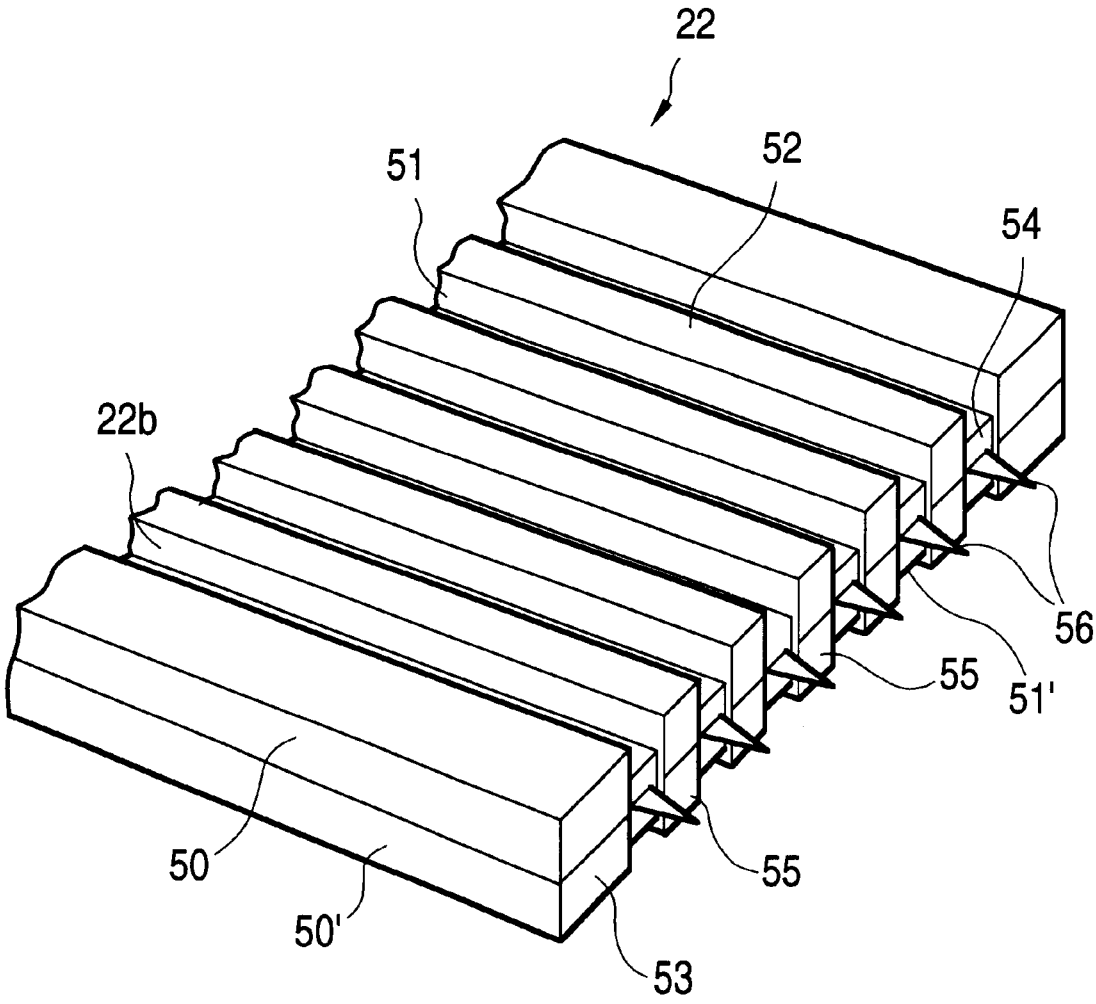
FIG. 10 schematically illustrates the main portions of a still other example of the ejecting head to be installed in the inkjet recording unit for use in the invention.
Figure 11:
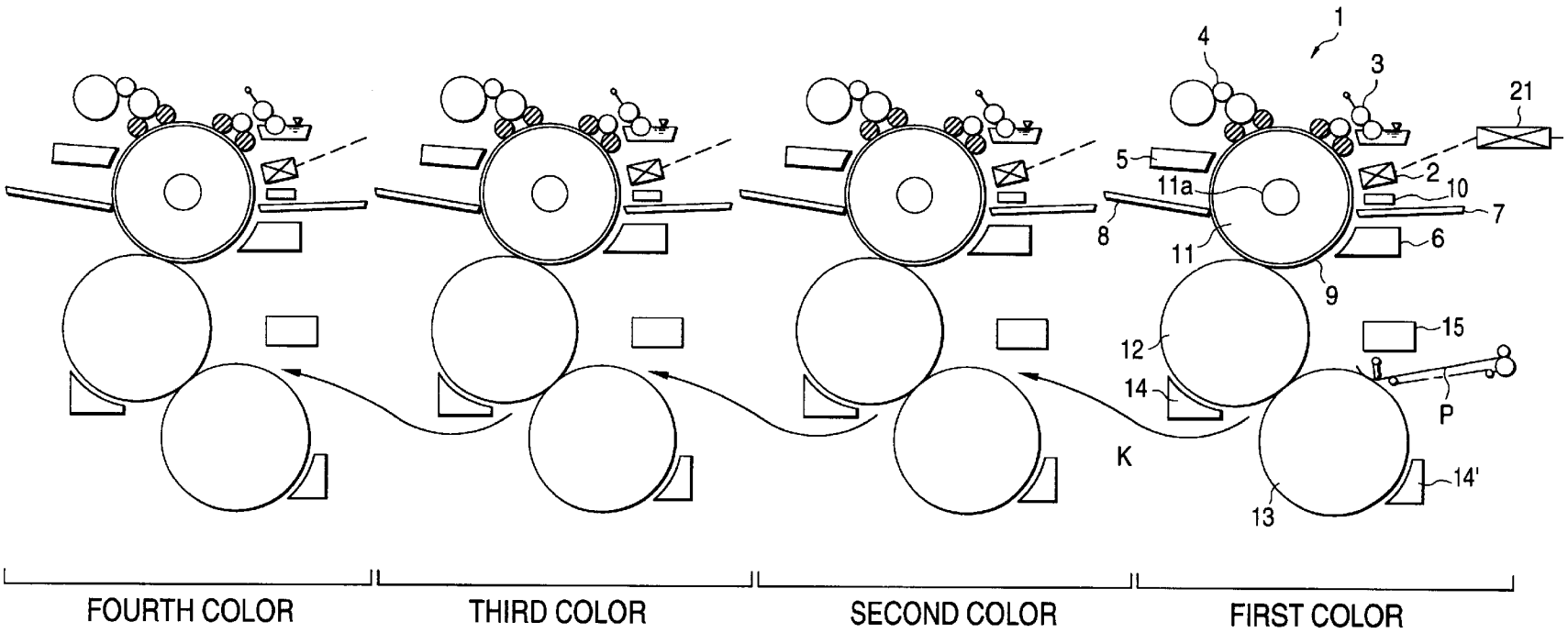
FIG. 11 schematically illustrates a computer-to-cylinder type four-color, single-side lithographic printing apparatus as an example of a multi-color printing apparatus according to the invention.

Still another example of the ejecting head is described with the help of FIG. 10. Ejecting head 22 has supporting means 50 and 50' made of substantially rectangular boards of plastic, glass or ceramic with 1 to 10 mm thickness. On one side of each board are formed plural grooves 51 and 51' parallel to each other. The spacing of the grooves is determined by the image resolution to be recorded. Each groove 51 or 51' should preferably be 10 to 200 μm wide and 10 to 300 μm deep. In each groove, ejecting electrode 22*b* is formed that covers the surface of the groove entirely or partially. By forming plural grooves 51 and 51' on one surface of supporting means 50 and 50', plural dividing walls 52 result between each groove 51. Supporting means 50 and 50' are bonded together at the surfaces opposite to the ones on which the grooves were formed.

As a result, on its outer surface, ejecting head 22 has a plurality of grooves to flow ink. Upper groove 51 is connected to lower groove 51' in one-to-one relationship via rectangular end 54 of ejecting head 33, and rectangular end 54 stands back relative to upper end 53 of ejecting head 22 by a pre-determined distance of about 50 to 500 μm. In other words, on both sides of each rectangular end 54, there is provided upper end 55 of each dividing wall 52 of each supporting means 50 and 50' in such a manner that upper end 55 protrudes from rectangular end 54. And, from each rectangular end 54, guiding projection 56 made of an insulator described previously protrudes to form an ejecting point. In order to circulate ink to ejecting head 22 thus constructed, ink is fed to rectangular end 54 through each groove 51 provided on the outer surface of supporting means 50, and discharged via each lower groove 51' formed in the opposite surface of lower supporting means 50'. To facilitate a smooth ink flow, ejecting head 22 is slanted by a pre-determined angle.

In other words, ejecting head 22 is slanted so that the feeding side (supporting means 50) be located higher than the discharge side (supporting means 50'). When ink is circulated in such an arrangement, ink passing each rectangular end 54 wets each projection 56 and forms an ink meniscus near rectangular end 54 and projection 56. Facing to the menisci thus formed independently on all projections, a plate cylinder holding a plate material thereon (both not shown in the figure) is arranged. By applying signal voltage modulated by image data to ejecting electrode 22*b* ink ejects from the ejecting point to form images on the plate material. Alternatively, ink can be compulsorily circulated by forming a cover sealing the grooves formed on the outer surfaces of supporting means 50 and 50', thus forming ink flow pipes running along the outer surfaces of each supporting means 50 and 50'. In such closed construction, ejecting head 22 need not be inclined.

Each ejecting head 22 depicted in FIG. 4 to FIG. 10 can be provided with maintenance devices such as cleaning member. For example, when the recording unit is suspended for a prolonged period or when some problems take place as for the quality of recorded images, the tip of the ejecting head is wiped with a soft brush or a piece of soft cloth, the ink solvent is fed to or circulated in the head together with or without suction of the head. These countermeasures may be used individually or in combination to keep the recording characteristics of the head in a desirable condition. To prevent ink solidification, head cooling is effective as it suppresses ink solvent vaporization. When the head is heavily contaminated, ink is compulsorily sucked from the ejecting end, or an air pulse or an ink solvent is injected from the head or the ink flow path. Alternatively, it is also effective to apply ultrasonic wave to the head immersed in the ink solvent. Those methods can be adopted individually or in combination.

Ink temperature control member 28 is needed to secure the consistency of the recorded image quality by keeping the physical properties of the ink almost constant and thus by suppressing dot size fluctuation. Temperature control can be carried out by any known method, for example, by providing ink tank 25 with a heat-generating or absorbing element such as heater or Peltier element together with agitating member 27 that averages the temperature distribution inside the tank and a temperature sensor such as thermostat. The temperature of the ink stored in tank 25 should preferably be kept between 15° C. and 60° C., and more preferably between 20° C. and 50° C.

Now, as a practical embodiment of the invention, a computer-to-cylinder type multi-color, single-side lithographic printing apparatus will be explained.

FIG. 11 depicts the entire construction of a computer-to-cylinder type four-color, single-side lithographic printing apparatus. As is shown in FIG. 11, this four-color, single-side printing apparatus basically comprises four single-color printing apparatuses shown in FIG. 1 comprising plate cylinder 11, blanket cylinder 12 and impression cylinder 13, arranged in series and in such a manner that printing is made on one side of printing paper P. The transport of the paper sheet between contiguous impression cylinders (designated only by K, but no hardware being shown in the figure) is carried out with a transfer cylinder well known in the art. As is readily conjectured from the example shown in FIG. 11, most of multi-color, single-side printing apparatuses consist of plural printing units comprising plate cylinder 11, blanket cylinder 12 and impression cylinder 13 arranged as described above. In the case where one plate corresponding to one color is formed on the plate cylinder of such a so-called unit type multi-color printing apparatus the printing apparatus has plural sets of a plate cylinder and a blanket cylinder in the number of colors to be printed.

On the other hand, the invention can be practiced with other types of multi-color printing apparatuses. One example comprises plural sets of a plate cylinder and a blanket cylinder in the number of colors to be printed combined with only one common impression cylinder having a diameter equal to the integer multiple of the plate cylinder diameter whereas another example comprises plural sets of the common impression cylinder-type structure described above in which the total number of the plate cylinders or the blanket cylinders is equal to that of colors to be printed. Paper sheets are delivered between contiguous impression cylinders with a transfer cylinder well known in the art.

In the case where plural plates corresponding to plural colors are formed on a plate cylinder, the number of the plate cylinders or the blanket cylinders is equal to the number of colors to be printed divided by the number of the plate formed on one plate cylinder. For example, when two plates for two colors are formed on one plate cylinder, four-color printing is possible with two such plate cylinders combined with two blanket cylinders. In this case, the diameter of the impression cylinder is made equal to that of the plate cylinder corresponding to one color while the impression cylinder is provided with means to retain the paper sheet thereon until all the necessary color images have been printed, and the sheet is delivered between contiguous impression cylinders with a transport cylinder well known in the art. For example, in the case of the four-color printing apparatus described above comprising two plate cylinders and two blanket cylinders in which two color plates are formed on each plate cylinder, one impression cylinder rotates twice holding a paper sheet to superimpose two color images thereon. A similar procedure is repeated on the sheet that is transported to and held on the second impression cylinder to complete a four-color printing. The number of impression cylinders may be either equal to that of plate cylinders, or one impression cylinder may be commonly combined to plural plate cylinder/blanket sets.

In the case where the invention is practiced on a computer-to-cylinder type, multi-color dual-side lithographic printing apparatus (perfector), a simple tandem structure comprising the so-called unit type structure can be used in which at least one paper reversing means well known in the art is arranged between contiguous impression cylinders. Or, more than one sets of plate cylinder/blanket cylinder shown in FIG. 1 are arranged in the both sides of the sheet transport path so as to carry out dual-side printing on printing sheet P. In the latter case, when each plate cylinder handles one color image, then the number of the sets of plate cylinder/blanket cylinder needed is equal to that of the colors used for the both sides of paper. On the other hand, when each cylinder handles plural color images, one can reduce the number of plate cylinder and/or impression cylinder. The number of impression cylinder can further be reduced if plural sets of plate cylinder/blanket cylinder use a common impression cylinder, in which case the impression cylinder must be equipped with means to retain a printing sheet for plural printing procedures. Further descriptions will be omitted as analogous to those for single-side type printing apparatuses.

Heretofore, some practical examples of computer-to-cylinder type multi-color lithographic printing apparatuses as embodiments of the invention have been explained on sheet-fed type multi-color printing apparatuses. However, the invention can be applied to web offset lithographic apparatuses, too. In particular, the unit type or the common impression cylinder type is suited. When the invention is applied to a computer-to-cylinder type multi-color web offset perfector, the unit type or the common impression cylinder type both described above can be used with at least one web reversing means provided between contiguous impression cylinders, or with such an arrangement of printing units as to carry out printing on both sides of paper. The most preferred computer-to-cylinder type multi-color web offset perfector is so called blanket-to-blanket (BE) type in which a set of plate cylinder/blanket cylinder is used to print one color image on one side of the web that is held by another blanket cylinder located on the other side of the web and that is used to print another image of the same color on that side of the web. A plurality of such structures are arranged in series to carry out multi-color both-side printing in which the web runs between the two blanket cylinders in pressed contact with each other.

As another embodiment of computer-to-cylinder type lithographic printing apparatus having two plate cylinders per one blanket cylinder, printing operations can be made on one plate cylinder while plate-making operations are simultaneously carried out on the other plate cylinder. In such an embodiment, the plate cylinder on which plate making is being done should be driven mechanically independently of the blanket. Then, image recording can be made without suspending the printing apparatus. As is readily understood by analogy, this concept is applicable to computer-to-cylinder type multi-color single- and both-side lithographic printing apparatuses.

Next, plate materials used in the invention will be described in detail.

Metal plates comprising aluminum or chromium-plated steel are preferred. Particularly, aluminum plates having a highly water-receptive and wear-resistant surface formed by graining and/or anodic oxidation are preferred. More economical materials include those comprising a superficial image-receiving layer provided on a water-resistant substrate including water-resistant paper, plastic films or paper/plastic film laminates. A preferable thickness range for such materials is 100 to 300 $\mu$m whereas the image-receiving layer preferably has a thickness of 5 to 30 $\mu$m.

Preferable examples of such image-receiving layers include hydrophilic layers comprising inorganic pigments and a binder, or those that can be converted hydrophilic via a suitable desensitizing treatment.

Inorganic pigments used in the hydrophilic image-receiving layer include clay, silica, calcium carbonate, zinc oxide, aluminum oxide and barium sulfate. Suitable binder materials include hydrophilic compounds such as poly (vinyl alcohol), starch, carboxymethyl cellulose, hydroxyethyl cellulose, casein, gelatin, polyacrylic acid salts, poly (vinylpyrolidone) and methyl ether-maleic anhydride copolymer. In the case where certain levels of water resistance are needed, cross-linking agents such as melamine-formaldehyde or urea-formaldehyde resin may be incorporated.

On the other hand, layers comprising zinc oxide dispersed in a hydrophobic binder represent image receiving ones used with a desensitizing treatment.

Any type of zinc oxide that is commercially available as zinc white, wet process zinc white or active zinc white can be used in the invention. As for zinc oxide, reference is made to p. 319 of "Shinpan Ganryo Binran" (Pigment Handbook, a New Edition) edited by Pigment Technology Association of Japan and published by Seibundo Publishing Co. in 1968.

Zinc oxide is classified according to its raw material and manufacturing process; dry procedures include French (indirect) and American (direct) processes, and wet processes are also employed. Representative products are available from manufacturers such as, for example, Seido Chemical Co., Sakai Chemical Co., Hakusui Chemical Co., Honjo Chemical Co., Toho Zinc Co., and Mitsui Metal Industries Co.

Resinous materials used for the binder of the zinc oxide layer include styrene copolymers, methacrylate copolymers, acrylate copolymers, vinyl acetate copolymers, poly (vinyl butyral), alkyd resins, epoxy resins, epoxy ester resins, polyester resins and polyurethane resins. Each of those may be used alone or in combination.

The content of the resin binder in the image-receiving layer preferably lies between 9/91 and 20/80 in terms of binder/zinc oxide weight % ratio.

Such a zinc oxide layer is desensitized by the treatment with a desensitizing solution well known in the art. Suitable desensitizing solutions include cyanide-containing ones comprising ferrocyanide or ferricyanide salts, cyanide-free ones comprising amine cobalt complexes, phytic acid and its derivatives or guanidine derivatives, those comprising inorganic or organic acids capable of forming a chelate with zinc ion, or those containing water-soluble polymers.

Cyanide-containing solutions are disclosed in, for example, Japanese Patent Publications No. 9045/1969 and No. 39403/1971, Japanese Patent Laid-Open No. 76101/1977, No. 107889/1982 and No. 117201/1979.

The back surface opposite to the image-receiving layer of the plate material should have a Beck smoothness of 150 to 700 (sec/10 mL). With such a back surface, the plate will not slip or shift during image transfer or on the plate cylinder, thus enabling a highly precise image transfer.

Beck smoothness can be measured with a Beck smoothness tester; a test piece is pressed against a circular hole provided at the center of a glass plate having an extremely smooth surface at a pre-determined pressure (1 kgf/cm$^2$ or 9.8 N/cm$^2$), and the time required for a fixed volume (10 mL) of air to leak between the glass plate and the test piece under a reduced pressure is measured.

The oil-based inkjet ink used in the invention will be explained in the following.

The oil-based ink used in the invention comprises a non-aqueous solvent that has a specific resistance not lower than $10^9$ Ωcm and a dielectric constant not exceeding 3.5, and a hydrophobic particulate resin dispersed in the solvent, the resin being solid at least at room temperature.

Such non-aqueous solvents with a specific resistance not lower than $10^9$ Ωcm and a dielectric constant not exceeding 3.5 and preferably used in the invention include straight- or branched-chain aliphatic hydrocarbons, alicyclic hydrocarbons, aromatic hydrocarbons, and halogen substituted derivatives of these hydrocarbons. Some examples are hexane, heptane, octane, isooctane, decane, isodecane, decaline, nonane, dodecane, indodecane, cyclohexane, cyclooctane, cyclodecane, benzene, toluene, xylene, mesitylene, Isopar C, Isopar E, Isopar G, Isopar H, Isopar L (Isopar is a trade name of EXXON Co.), Shellsol 70, Shellsol 71 (Shellsol is a trade name of Shell Oil Co.), Amsco OMS, Amsco 460 solvent (Amsco is a trade name of Spirits Co.) and silicone oil. They are used in pure form or as mixtures. The upper limit of the specific resistance of these non-aqueous solvents is about $10^{16}$ Ωcm while the lower limit of the dielectric constants is about 1.9.

When the resistance of the non-aqueous solvent used in the invention is below the lower limit of the preferable range mentioned above, the resinous particles will not be concentrated, resulting in output images with insufficient run lengths while, when the dielectric constant exceeds the upper limit of the preferable range mentioned above, too much field relaxation occurs due to the polarization of the solvent, deteriorating the consistency of ink ejection.

The particulate resin dispersed in the non-aqueous solvent described above should preferably be solid at temperatures not exceeding 35° C., and have a sufficient affinity to non-aqueous solvents. Moreover, those having a glass transition temperature (Tg) ranging from −5° C. to 110° C., or a softening point ranging from 33° C. to 140° C. are desirable. More preferably, those with a Tg between 10° C. and 100° C., or with a softening point between 38° C. and 120° C. are used. Still more preferably, Tg should be from 15° C. to 80° C., or the softening point from 38° C. to 100° C.

By using such resins satisfying the conditions for Tg or softening point, the affinity between the surface of the image-receiving layer of the plate and the particulate resin is sufficiently intense, and at the same time, the binding force among the resin particles is large. Therefore, the adhesion between the image and the image-receiving layer and thus the print durability of the plate are enough. With resins with Tg's or softening points outside the preferred range cited above, the affinity between the image-receiving layer and the particulate resin is not enough, or the binding strength among the resin particles is insufficiently weak.

The weight-averaged molecular weight Mw of P should be $1\times10^3$ to $1\times10^6$, preferably $5\times10^3$ to $8\times10^5$ and more preferably $1\times10^4$ to $5\times10^5$.

Practical examples of such resinous materials (P) include olefinic polymers and copolymers such as, for example, polyethylene, polypropyrene, polyisobutyrene, ethylene-vinyl acetate copolymers, ethylene-acrylate copolymers, ethylene-methacrylate copolymers, and ethylene-methacrylic acid copolymers, vinyl chloride polymers and copolymers such as poly (vinyl chloride) and vinyl chloride-vinyl acetate copolymers, vinylidene chloride copolymers, polymers and copolymers of vinyl esters of alkanoic acid, polymers and copolymers of allyl esters of alkanoic acid, polymers and copolymers of styrene or styrene derivatives such as, for example, butadiene-styrene copolymers, isoprene-styrene copolymers, styrene-methacrylate copolymers and styrene-acrylate copolymers, acrylonitrile copolymers, methacrylonitrile copolymers, alkyl vinyl ether copolymers, polymers and copolymers of acrylic acid esters, polymers and copolymers of methacrylic acid esters, polymers and copolymers of itaconic acid diesters, maleic acid copolymers, acrylamide copolymers, methacrylamide copolymers, phenol resins, alkyd resins, polycarbonate resins, ketone resins, polyester resins, silicone resins, amide resins, hydroxy and carboxy group-modified polyester resins, butyral resins, poly (vinyl acetal) resins, urethane resins, rosin-based resins, hydrogenated rosin-based resins, petroleum resins, hydrogenated petroleum resins, maleic acid resins, terpene resins, hydrogenated terpene resins, coumarone-indene resins, cyclized rubber-methacrylate copolymers, cyclized rubber-acrylate copolymers, copolymers containing nitrogen-free heterocyclic rings (exemplified by furan, tetrahydrofuran, thiophene, dioxane, dioxofuran, lactone, benzofuran, benzothiophene and 1,3-dioxetane) and epoxy resins.

The content of the resin dispersed in the oil-based ink of the invention should preferably be 0.5 to 20% by weight based on the total ink quantity. Contents below the cited range tend to cause various problems such as a poor wear resistance of recorded images due to a poor affinity of the ink to the plate surface, while, with those exceeding the cited range, homogeneous dispersion becomes difficult, or the ink flow in the ejecting head tends to be non-uniform, hindering a consistent ink ejection.

In addition to the dispersed resin particles described above, the oil-based ink used in the invention can contain a coloring agent that makes visual plate inspection easy after plate making.

As preferable examples of such coloring agents, pigments or dyestuffs that have been conventionally used in various ink formulations or liquid toners for electrophotography are included.

Inorganic or organic pigments that have been widely used in graphic arts can be applied to the present purpose without any special limitation, including, for example, carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanines, quinacrydones, isoindolinones, dioxazines, indanthrenes, perylenes, perynones, thioindigo pigments, quinophthalone pigments, metal complex pigments, and still other ones known in the art.

Suitable dyestuffs include oil-soluble dyes such as azo dyes, metal complex salt dyes, naphthol dyes, anthraquinone dyes, indigo dyes, carbonium dyes, quinonimine dyes, xanthene dyes, aniline dyes, quinoline dyes, nitro dyes, nitroso dyes, benzoquinone dyes, naphthoquinone dyes, phthalocyanine dyes and metal phthalocyanine dyes.

Each of these pigments and dyestuffs can be used individually or in combination. A preferable range of the content is from 0.01 to 5% by weight of the entire ink quantity.

These coloring agents may be dispersed in the non-aqueous solvent independently from the dispersed particulate resin, or incorporated in the particulate resin. In the latter case, pigments are often coated with resinous materials, and dyestuffs are used to dye the surface of the dispersed particles.

The average particle size of the particulate resin and the particle of coloring agents dispersed in the non-aqueous solvent should preferably be 0.05 to 5 $\mu$m, and more preferably 0.1 to 1.0 $\mu$m. These particle size values were determined with CAPA-500 manufactured by Horiba Manufacturing Co.

The particulate resin dispersed in the non-aqueous solvents used in the invention can be prepared by conventional mechanical grinding or particle-forming polymerization processes known in the art. As a typical mechanical method, all the ingredients for the particulate resin are mixed, melted and then blended, followed by direct grinding with a grinder; the obtained fine particles together with a polymer dispersant are further dispersed with a wet-type dispersing machine (e.g., ball mill, paint shaker, KD mill or Dyno mill) Another method comprises first preparing a mixture comprising all the ingredients for the particulate resin and an ancillary polymer dispersant (or a polymer for coating), then finely dividing the mixture and finally dispersing the finely divided resin in the presence of a polymer dispersant. Suitable methods include those for the preparation of paint or electrophotographic liquid toner, and detailed descriptions on those are found in, for example, "Paint Flow and Pigment Dispersion", supervised and translated by Kenji Ueki (Kyoritsu Shuppan Publishers Co., 1971), "Paint Science" by Solomon (Hirokawa Shoten Co., 1969) and "Coating Engineering" (Asakura Shoten, 1971) and "Basic Science of Coating" (Maki Shoten, 1977), both authored by Yuji Harasaki.

As particle-forming polymerization methods, dispersion polymerization in non-aqueous systems is well known. Practical descriptions are found in Chapter 2 of "Recent Technologies of Ultra-fine Polymers", supervised by Souichi Muroi (CMC Shuppan, 1991), Chapter 3 of "Recent Electrophotographic Developing System and Development of Toner Materials" by Koichi Nakamura (Nihon Kagaku Joho Co., 1985) and "Dispersion Polymerization in Organic Media" by K. E. J. Barrett (John Wiley, 1975).

Usually, in order to stably disperse a particulate resin in a non-aqueous solvent, a polymer dispersant is used. Such a polymer dispersant comprises, as its principal component, a recurring unit that is soluble in the non-aqueous solvent preferably having a weight-averaged molecular weight Mw of from $1\times10^3$ to $1\times10^6$, more preferably from $5\times10^3$ to $5\times10^5$.

Some preferable examples for such a recurring unit for the polymer dispersant include those represented by the following general formula (I).

(I)

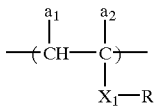

In General formula (I), $X_1$ represents —COO—, —OCO— or —O—, and R represents an alkyl or alkenyl group of $C_{10-32}$, more preferably those of $C_{10-22}$ having straight or branched chains. Though those chains may be substituted or unsubstituted, unsubstituted ones are more preferred.

Practical examples thereof include decyl, dodecyl, tridecyl, tetradecyl, hexadecyl, octadecyl, eicosanyl, docosanyl, decenyl, dodecenyl, tridecenyl, hexadecenyl, octadecenyl and linolenyl.

In General formula (I), $a_1$ and $a_2$ may be the same or different, representing a hydrogen or halogen atom such as chlorine or bromine, cyanide, an alkyl group of $C_{1-3}$ such as methyl, ethyl and propyl, —COO—$Z_1$, or —$CH_2$COO—$Z_1$ wherein $Z_1$ represents a hydrocarbon group containing carbon atoms not more than 22 such as alkyl, alkenyl, aralkyl, alicyclic and aryl.

The hydrocarbon groups represented by $Z_1$ include the following: an alkyl group of $C_{1-22}$ that may be substituted, such as methyl, ethyl, propyl, butyl, hexyl, heptyl, octyl, nonyl, decyl, dodecyl, tridecyl, teteradecy, hexadecyl, octadecyl, eicosanyl, docosanyl, 2-chloroethyl, 2-bromoethyl and 3-bromopropyl, an alkenyl group of $C_{4-18}$ that may be substituted, such as 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl and linolenyl, an aralkyl group of $C_{7-22}$ that may be substituted, such as benzyl, phenethyl, 3phenylpropyl, naphthylmethyl, 2-naphthylethyl, chlorobenzyl, bromobenzyl, methylbenzyl, ethylbenzyl, methoxybenzyl, dimethylbenzyl, ethylbenzyl, methoxybenzyl, dimethylbenzyl and dimethoxybenzyl, an alicyclic group of $C_{5-8}$ that may be substituted, such as cyclohexyl, 2-cyclohexylethyl and 2-cyclopentylethyl, and an aromatic group of $C_{6-12}$ that may be substituted, such as phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chloropheyl, dichlorophenyl, bromophenyl, cyanophenyl, acetylphenyl, methoxycarbonylphenyl, ethoxycarbonylphenyl, butoxycarbonylphenyl, acetamidephenyl, propionamidephenyl and dodecyloylamidophenyl.

Suitable polymer dispersants can have other recurring units copolymerized with those represented by General formula (I). Such copolymerization components may consist of any monomer copolymerizable with the monomers corresponding to the recurring unit in General formula (I).

The ratio of the polymer component represented by General formula (I) to the total quantity of the polymer dispersant should preferably be not less than 50% by weight, and more preferably not less than 60% by weight.

Some practical examples of such a polymer dispersant include the dispersion stabilizing resin Q-1 used in the following example and commercially available products such as Solprene 1205 of Asahi Chemical Co.

The polymer dispersant should preferably be present in the polymerization system for the polymer P defined previously in the case where the polymer P is manufactured in the form of latex.

The amount of the polymer dispersant added to the system is from 1 to 50% by weight based on the weight of the polymer P.

The particulate resin and the coloring particles (or the particles of a coloring agent) should be in the form of charge-detecting particles with a positive or negative polarity.

To impart a charge-detecting capability to such particles, the technologies used for the preparation of electrophotographic liquid toner are preferably employed. Practical descriptions on charge direction as well as charge directors and suitable additives are found in p. 139–148 of "Recent Electrophotographic Development System and Development of Toner Materials" by Koichi Nakamura cited previously, p. 497–505 of "Fundamentals and Applications of Electrophotographic Technologies", edited by The Society of Electrophotography of Japan.(Corona Co., 1988) and a literature written by Yuji Harasaki in p. 44 of Journal of the Society of Electrophotography of Japan, 16(2), (1977).

Preferable charge-directors are disclosed in, for example, UK Patent Nos. 893429 and 1122397, U.S. Pat. Nos. 3,900,412 and 4,606,989, Japanese Patent Laid-Open Nos. 179751/1985, 185963/1985 and 13965/1990.

The above described charge directors are preferably added to 1000 parts by weight of carrier liquid by from 0.001 to 1.0 parts by weight. Various additives may be incorporated to the ink formulation. The total amount of such additives is limited by the resistance of the oil-based ink: the specific resistance of the liquid phase after the dispersed particles have been removed must be higher than $10^9$ Ωcm, below which good quality continuous tone images can hardly be obtained.

The present invention will be illustrated in greater detail with reference to the following Examples, but the invention should not be construed as being limited thereto.

First, an example of manufacturing a particulate resin for inkjet ink (PL) will be given.

Manufacturing Example 1 for Particulate Resin (PL-1)

A mixture consisting of 10 g of a polymer dispersant (Q-1) having the formula given below, 100 g of vinyl acetate and 384 g of Isopar H in nitrogen atmosphere was heated to 70° C. under stirring. The mixture was then added with 0.8 g of 2,2'-azo-bis(isovaleronitrile) (A.I.V.N.) as polymerization initiator, and allowed to react for 3 hours. In 20 minutes after the addition of the initiator, the mixture turned turbid and the temperature rose to 88° C. After the addition of 0.5 g of the initiator, the mixture was agitated for 2 hours at 100° C. to remove the remaining vinyl acetate. The reaction product was filtered with a 200-mesh nylon cloth after cooling to give a monodisperse, stable latex of 0.23 μm average particle diameter with a polymerization rate of 90%. The particle diameter was measured with CAPA-500, a product of Horiba Manuf. Co., Ltd.

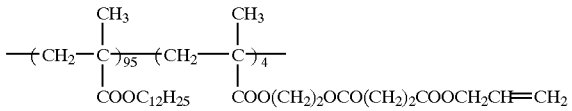

$Mw = 5 \times 10^4$ (Copolymerization ratio is expressed by weight ratio.)

Part of the latex was centrifuged at $1\times10^4$ r.p.m. for 60 min, and the resulting sediment consisting of the polymer particles was collected and dried. The weight-averaged molecular weight (Mw: polystyrene equivalent GPC value) of the polymer was $2\times10^5$ and its Tg was 38° C.

EXAMPLE 1

First of all, oil-based ink was prepared.

<Preparation of oil-based ink (IK-1)>

A fine dispersion of nigrosine was prepared by rigorously grinding 10 g of a dodecyl methacrylate/acrylic acid copolymer with a copolymerization ratio of 95/5 in terms of weight %, 10 g of nigrosine and 30 g of Shellsol 71 in a paint shaker (a product of Tokyo Seiki Co., Ltd.) together with glass beads for 4 hours.

An oil-based black ink was prepared by adding 60 g (as the solid content) of particulate resin PL-1 described in Manufacturing example 1, 2.5 g of the nigrosine dispersion prepared above, 15 g of FOC-1400 (tetradecyl alcohol produced by Nissan Chemical Co., Ltd.) and 0.08 g of an octadecene-maleic acid half hexadecylamide copolymer into one liter Isopar G.

Oil-based ink (IK-1) thus prepared was charged by 2 liters in the ink tank of inkjet recording unit 2 in the plate making apparatus (See FIG. 1 and FIG. 2). In this example, a multi-channel type ink ejecting head having 64 channels of 900 (dot/25.4 mm) shown in FIG. 4 and kept at 30° C. with use of a Peltier element was used. The recording resolution along the main and sub-scanning directions was set to 900 (dot/25.4 mm), and the highest driving frequency for the recording head was 5 kHz. Every other ejecting channel was actuated simultaneously (n=3) while the rotational speed of the plate cylinder was adjusted to about 423 mm/sec with the output of an encoder equipped on the plate cylinder.

After every three rotations of the plate cylinder, the head was moved along the axis of the plate cylinder until the recording was done on the entire area of the plate material. By equipping the ink tank with a throw-in heater and agitation blades as an ink temperature control member, the ink temperature was kept at 30° C. The blades were rotated at 30 rpm and a thermostat was used to keep the temperature constant. This agitating member was also used to prevent sedimentation or aggregation. A transparent window was equipped along the ink flow path through which a set of a LED device and a light detector monitored the ink concentration. Based on signals from the detector, an ink diluent (Isopar G) or an ink concentrate (having a solid concentration twice as much as that of ink IK-1 described above) was added to the ink for concentration control.

A plate material comprising an 0.12 mm thick aluminum plate the surface of which had been grained followed by anodic oxidation was loaded on the plate cylinder of the plate making apparatus by means of a mechanical plate loader that holds the leading and trailing edges of the plate. The dampening device, the ink-feeding device and the blanket cylinder were separated not to touch the plate material. After the dust present on the plate material surface was eliminated with air suction using a pump, the ejecting head was approximated to the recording position close to the plate material. Based on the image data to be printed sent to the image processing and control unit, the head recorded an image on the aluminum plate with the ejected oil-based ink. In the recording, the end width of the ejecting electrode was set to 10 $\mu$m while the gap between the head and the plate material was adjusted to lam by using an optical gap detector.

To a bias voltage of 2.5 kV constantly applied to the ejecting electrode, a 500 V pulse voltage was superimposed for ink ejection, and the dot area was controlled by changing the voltage pulse duration from 0.2 milisec to 0.05 milisec in 256 steps. Thus, a high quality recording with locationally accurate dot formation resulted. Image deterioration, for example, due to dust, did not take place at all and the dot area was quite stable under drifting external atmospheric temperatures and/or with the increase of processed plate number. The image thus formed was strengthened by heating with a xenon flash fixing apparatus (a product of Ushio Electric Co., Ltd., with an emission intensity of 200 J/pulse). To protect the inkjet head, the inkjet recording unit was retreated back from the recording position close to the plate cylinder together with the sub-scanning means by about 50 mm. Then, ordinary lithographic printing operations were carried out on the sheets of coated printing paper in which a process ink and dampening water were fed onto the plate to form a process ink image, which was transferred to the blanket cylinder rotating together with the plate cylinder followed by further transfer onto coated paper sheets passing between the blanket cylinder and the impression cylinder.

The resulting lithographic prints had sharp and crisp images free of void or blur even after 10,000 runs. After plate making, Isopar G was fed to the ejecting head from the head aperture for 10 min, and then the solvent was drained off from the aperture to clean the head. The head was stored in a closed space filled with the vapor of Isopar G. By such an operation, the head operated perfectly for 3 months without any additional maintenance, consistently making high quality plates for printing.

EXAMPLE 2

By using a circulation pump as agitating member, a 600 (dots/25.4 mm) full-line inkjet head shown in FIG. 6 was heated to 35° C. with a heater and a thermostat. With the following recording conditions, i.e., recording resolution along the main scanning direction of 1200 (dots/25.4 mm) that along the sub-scanning direction of 600 (dots/25.4 mm), the highest head driving frequency of 4 kHz, simultaneous actuation of every third channels (n=3), and the rotational speed of the plate cylinder of about 254 mm/sec at the surface that was regulated by the output from the encoder equipped on the plate cylinder, image recording was performed on the entire area of the plate material in three rotations of the plate cylinder. Ink reservoirs were formed between the pump and the ink inflow path of the ejecting head, and between the ink recovery path of the ejecting head and the ink tank, and ink was circulated by making use of the head difference between those reservoirs together with the pump. The ink temperature was controlled with a heater and the pump at 35° C. This temperature was maintained with a thermostat.

The circulation pump was also used as an agitating member for precipitation and aggregation prevention. In the ink flow path, an electro-conductivity measuring device was installed, which output signal was used for the concentration management by replenishing either an ink diluent or concentrate. As the plate material, the aluminum plate used in Example 1 was loaded on the plate cylinder of the lithographic printing apparatus in a similar manner. After cleaning dust present on the plate surface, with a rotating nylon brush, an image was recorded on the aluminum plate by rotating the plate cylinder and ejecting the oil-based ink from a full-line head. The ejecting head was controlled by the signals from the image data processing and control unit that received the data of the original image to be recorded. A high quality recording with locationally accurate dot formation resulted. Image deterioration due to dust did not take place at all and the dot area was quite stable under drifting external atmospheric temperatures and/or with the increase of processed plate number. Then, the image was strengthened by heating with a heating roll (a product of Hitachi Metal Ltd. with 1.2 kW power consumption).

Lithographic printing was performed with the thus heated plate, giving rise to prints with sharp and crisp images free of blur or void even after 10,000 runs. After the plate making, the head was washed by circulating Isopar G followed by bringing a piece of non-woven fabric wetted with Isopar G. With such cleaning, the head worked desirably for 3 months without any additional maintenance.

Similar results were obtained by using another 600 dpi full line inkjet head having a structure shown in FIG. 8 and FIG. 10 instead of the one shown in FIG. 6.

EXAMPLE 3

An inkjet recording unit which had a 64 channel multichannel head of 100 dots/25.4 mm spatial density was installed on a four-color single-side lithographic printing apparatus (See FIG. 11). A spacing roller made of Teflon was used to adjust the gap to 0.8 mm. The recording resolution along the main and sub-scanning directions was set to 600 dots/25.4 mm. Area modulation of dot was performed by changing the pulse width from 90 $\mu$m to 190 $\mu$m in 16 steps. As for he ad actuation, the highest driving frequency was 5 kHz, every other ejecting channel was actuated (n=2) and the rotational speed of the plate cylinder was controlled to about 423 mm/sec at the cylinder surface with the output of an encoder equipped on the plate cylinder.

Further, after every two rotations of the plate cylinder, the head was moved along the axial direction of the cylinder in interlace mode until the entire area was printed. A similar ink concentration control to that in Example 1 was carried out except that the replenishment of ink concentrate was made according to the integral number of printed plate until 5000 plate makings were done.

A high quality recording with locationally accurate dot formation resulted. Image deterioration due to dust did not take place at all and the dot area was quite stable under drifting external atmospheric temperatures. With the increase of the number of processed plate, some fluctuations in dot size were observed only within an allowable limit. Then, the image was fixed by various methods including the flush fixing described in Example 1, irradiation with a halogen lamp (a product of Ushio Denki Co., Ltd., 1.5 kW power consumption), and spraying of ethyl acetate.

In the fixing with a halogen lamp, the temperature at the plate surface was adjusted to 95° C. and the radiation lasted for 20 sec. On the other hand, in the fixing with ethyl acetate, the sprayed amount was controlled to 1 g/m$^2$. Sharp and crisp full-color prints resulted free of image defects such as blur or void even after 10,000 runs. In the fixing with the heating roll or the halogen lamp, the fixing time was markedly shortened by wrapping the plate cylinder with an adiabatic material such as PET film in which case the aluminum base was grounded by means of a conductive brush, Thunderlon made by Tsuchiya Co. having a resistance of about $10^{-1}$ Ωcm.

EXAMPLE 4

Instead of the aluminum plate used in Example 1, a plate material was used comprising a paper substrate on which the following hydrophilic image-receiving layer was provided. The remaining conditions and procedures were the same as in Example 1.

By providing both sides of a premium grade paper of 100 g/m$^2$ grammage with a water-resistant layer comprising kaolin, poly (vinyl alcohol), a SBR latex and a melamine-formaldehyde resin, a water-resistant substrate was produced. On the resulting substrate was coated dispersion A having the following composition at a coating weight of 6 g/m$^2$ on dry base to give an image-receiving layer.

Dispersion A

| | |
|---|---|
| Gelatin (Wako Chemical Co., first grade) | 3 g |
| Colloidal silica (Snowtex C of Nissan Chemical Co., a 20% aqueous dispersion) | 20 g |
| Silica gel (Sailicia #310 of Fuji Silicia Chemical Co.) | 7 g |
| Hardening agent | 0.4 g |
| Distilled water | 100 g |

These ingredients were blended in a paint shaker together with glass beads for 10 min.

The resulting prints were sharp and crisp free of image defects such as blur or void even after 10,000 runs.

On the other hand, when bond paper was used instead of coated paper, voids began to occur in solid areas due to paper dust at 3,000 runs. Thus, an air suction pump was arranged near the paper-feeding unit. Due to this countermeasure, more than 5,000 high quality prints without void or blur were obtained. However, the image stretched by 0.1 mm along the lengthwise direction of A3 size print for run lengths exceeding 5,000.

EXAMPLE 5

Instead of the aluminum plate used in Example 1, a plate material having an image receiving layer that can be converted hydrophilic via the following desensitizing treatment was used for image recording After image recording, a desensitizing device was used to make the none image area hydrophilic. During image recording, an electro-conductive board spring made of phosphor bronze was kept in contact with the conductive layer of the plate material for grounding, and the imaged plate was heated with hot air stream for image fixing. The other conditions and procedures were the same as in Example 1.

Both sides of a premium grade bond paper having a weight of 100 g/m$^2$ were laminated with a 20 μm thick polyethylene film. The resulting water-resistant substrate was coated with a conductive paint having the following composition on one side in such a manner that the coated amount be 10 g/m$^2$ after drying. On the conductive layer was provided an image-receiving layer having a coating weight of 15 g/m$^2$ on dry base by coating dispersion B.

Conductive paint: a mixture of the following ingredients.

| | |
|---|---|
| Carbon black (30% aqueous dispersion) | 5.4 parts |
| Clay (50% aqueous dispersion) | 54.6 parts |
| SBR latex (solid content 50%, Tg = 25° C.) | 6 parts |
| Melamine resin (Sumilez Resin SR-613 of Sumitomo Chemical, solid content = 80%) | 4 parts |
| Water to make the solid content equal to 25% | |

Dispersion B

A mixture comprising 100 g of zinc oxide produced by dry process, 3 g of a binder resin (B-1), 17 g of another binder resin (B-2) each having the following formula, 0.15 g of benzoic acid and 155 g of toluene, prepared with a wet-type homogenizer made by Nippon Seiki Co. rotated at 6,000 rpm for 8 min.

Binder resin B-1

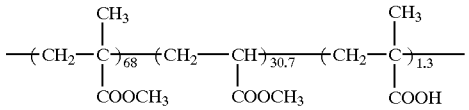

Mw = 9 × 10$^3$

Binder resin B-2

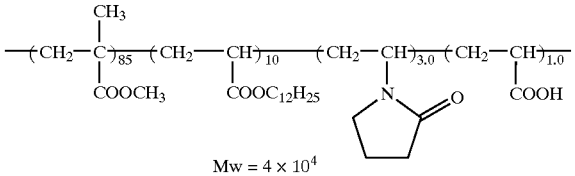

Mw = 4 × 10$^4$ (The copolymerization ratios are given by weight.)

The resulting prints had sharp and crisp images free of blur or void even after 5,000 runs.

According to the invention, the electrostatic field interference among the ejecting channels of a recording head can be prevented, enabling a large number of high quality prints to be produced. Further, high quality printing plates corresponding to digital image data can be directly obtained consistently, thus enabling an economical and high-speed lithographic printing.

While the present invention has been described in detail and with reference to specific examples thereof, it will be apparent to one skilled in the art that various changes and modifications can be made therein without departing from the spirit and scope thereof.

What is claimed is:

1. A method of computer-to-cylinder lithographic printing, comprising:

loading a plate material on a rotative plate cylinder of a lithographic printing apparatus;

rotating said plate cylinder having loaded thereon the plate material;

forming an image directly onto the plate material by an inkjet image-recording process which comprises ejecting an oil-based ink from a recording head having a plurality of ejecting channels, based on image data signals, utilizing an electrostatic field, to prepare a printing plate;

subsequently performing lithographic printing with the thus prepared printing plate, wherein said recording head is driven so that every n'th channel thereof is actuated in a common phase, and wherein said plate cylinder is rotated to give a surface rotational speed V (mm/sec) of the plate material as represented by the following formula:

$$V=25.4\times(f\times n)/N$$

wherein N represents a recording resolution (dots/25.4 mm) along a rotative direction of the plate cylinder on said plate material, and f represents a driving frequency f (Hz) of each ejecting channel of said recording head.

2. The computer-to-cylinder lithographic printing method according to claim 1, wherein said oil-based ink comprises:

a non-aqueous solvent having a specific resistance not lower than $10^9$ Ωcm and a dielectric constant not higher than 3.5; and a hydrophobic particulate resin dispersed in said solvent, the resin being solid at least at room temperature.

3. A computer-to-cylinder lithographic printing apparatus comprising:

a rotative plate cylinder on which a plate material is to be loaded;

an image forming unit comprising an inkjet recording unit including a recording head having a plurality of ejecting channels so as to form an image directly on the plate material loaded on said plate cylinder by ejecting an oil-based ink from said recording head, based on image data signals, utilizing an electrostatic field to prepare a printing plate;

an image data processing and control unit which drives said recording head so that every n'th channel of said recording head is actuated in a common phase;

a plate cylinder's rotational speed-controlling unit which controls the rotational speed of said plate cylinder to give a surface rotational speed V (mm/sec) of the plate material as represented by the following formula:

$$V=25.4\times(f\times n)/N$$

wherein N represents a recording resolution (dots/25.4 mm) along a rotative direction of the plate cylinder on said plate material, and f represents a driving frequency f (Hz) of each ejecting channel of said recording head; and a lithographic printing unit which performs lithographic printing with the thus prepared printing plate.

4. The computer-to-cylinder lithographic printing apparatus according to claim 3, wherein said oil-based ink comprises:

a non-aqueous solvent having a specific resistance not lower than $10^9$ Ωcm and a dielectric constant not higher than 3.5; and a hydrophobic particulate resin dispersed in said solvent, the resin being solid at least at room temperature.

5. The computer-to-cylinder lithographic printing apparatus according to claim 3, wherein said image forming unit further comprises an ink fixing unit.

6. The computer-to-cylinder lithographic printing apparatus according to claim 3, wherein said image forming unit further comprises a dust cleaning unit which removes dust present on the plate at least one of prior to and during image recording onto said plate material.

7. The computer-to-cylinder lithographic printing apparatus according to claim 3, wherein said image forming unit rotates said plate cylinder to perform main scanning upon image recording onto the plate material.

8. The computer-to-cylinder lithographic printing apparatus according to claim 7, wherein said recording head comprises multiple channels and is movable along a direction parallel to an axis of said plate cylinder to perform sub-scanning upon image recording onto the plate material.

9. The computer-to-cylinder lithographic printing apparatus according to claim 7, wherein said recoding head comprises a full-line head having a width substantially equal to that of said plate material.

10. The computer-to-cylinder lithographic printing apparatus according to claim 3, wherein said inkjet recording unit further comprises an ink feeding member which feeds the ink to said recording head.

11. The computer-to-cylinder lithographic printing apparatus according to claim 10, wherein said inkjet recording unit further comprises an ink recovery member which recovers said oil-based ink from said recording head to circulate said ink in cooperation with said ink feeding member.

12. The computer-to-cylinder lithographic printing apparatus according to claim 3, wherein said inkjet recording unit further comprises an ink tank and an ink agitating member installed inside said ink tank.

13. The computer-to-cylinder lithographic printing apparatus according to claim 12, wherein said inkjet recording unit further comprises an ink temperature control member installed inside said ink tank.

14. The computer-to-cylinder lithographic printing apparatus according to claim 3, wherein said inkjet recording unit further comprises an ink concentration control member.

15. The computer-to-cylinder lithographic printing apparatus according to claim 3, wherein said inkjet recording unit further comprises a recording head distancing/approximating member capable of approximating said recording head to said plate cylinder upon image recording onto the plate material and of distancing said recording head from said plate cylinder except during the image recording.

16. The computer-to-cylinder lithographic printing apparatus according to claim 3, wherein said image forming unit further comprises a cleaning member which cleans said recording head at least after the completion of the plate making.

17. The computer-to-cylinder lithographic printing apparatus according to claim 3, wherein said lithographic printing unit comprises a dust removing member which removes paper dust generating during lithographic printing.

18. The computer-to-cylinder lithographic printing apparatus according to claim 3, wherein said image forming unit has a recording head temperature control member.

* * * * *